US011950732B2

(12) United States Patent
Hata et al.

(10) Patent No.: US 11,950,732 B2
(45) Date of Patent: Apr. 9, 2024

(54) TOILET DEVICE

(71) Applicants: TOTO LTD., Kitakyushu (JP); DAIICHI KASEI CO., LTD., Shimotsuke (JP); YOKO INDUSTRY CO., LTD., Tokyo (JP)

(72) Inventors: Hiroki Hata, Kitakyushu (JP); Yuji Maruyama, Shimotsuke (JP); Maya Teraoka, Tokyo (JP); Haruki Suzuki, Shimotsuke (JP); Toshihiko Shimizu, Shimotsuke (JP)

(73) Assignees: TOTO LTD., Fukuoka (JP); DAIICHI KASEI CO., LTD., Tochigi (JP); YOKO INDUSTRY CO., LTD., Tokyo (JP)

( * ) Notice: Subject to any disclaimer, the term of this patent is extended or adjusted under 35 U.S.C. 154(b) by 39 days.

(21) Appl. No.: 17/931,607

(22) Filed: Sep. 13, 2022

(65) Prior Publication Data

US 2023/0096194 A1 Mar. 30, 2023

(30) Foreign Application Priority Data

Sep. 28, 2021 (JP) ..... 2021-158242

(51) Int. Cl.
*A47K 13/10* (2006.01)

(52) U.S. Cl.
CPC ..... *A47K 13/10* (2013.01); *A47K 13/105* (2013.01)

(58) Field of Classification Search
CPC ..... A47K 13/10; A47K 13/24
See application file for complete search history.

(56) References Cited

U.S. PATENT DOCUMENTS 11,805,949 B2 * 11/2023 Hata ..... A47K 13/10
2005/0217010 A1 10/2005 Hayashi et al.

FOREIGN PATENT DOCUMENTS

| | | | |
|---|---|---|---|
| JP | 2004-180700 | A | 7/2004 |
| JP | 2005-102810 | A | 4/2005 |
| JP | 4574168 | B2 | 11/2010 |
| JP | 2017-006352 | A | 1/2017 |
| KR | 20-0408974 | Y1 | 2/2006 |

OTHER PUBLICATIONS

Decision to Grant for the corresponding Japanese Patent Application No. 2021-158242 dated Aug. 29, 2023.

* cited by examiner

*Primary Examiner* — Erin Deery
(74) *Attorney, Agent, or Firm* — PEARNE & GORDON LLP

(57) ABSTRACT

A toilet device includes an electric opening/closing unit including a motor and a transmission mechanism. The transmission mechanism includes an internal gear, a first transmission part and a second transmission part. The first transmission part transmits a rotational force of the motor. The second transmission part transmits a rotational force of the first transmission part. The first transmission part includes a first planetary gear and a first planetary carrier. The second transmission part includes a second planetary gear, a second planetary carrier, and a shaft part. The shaft part revolves around a rotation axis. The first planetary carrier includes a protrusion extends along a trajectory of the revolution of the shaft part. The shaft part contacts the protrusion. A gap is formed between the shaft part and a part of the first planetary carrier other than the protrusion.

3 Claims, 16 Drawing Sheets

TOILET DEVICE

CROSS-REFERENCE TO RELATED APPLICATIONS

This application is based upon and claims the benefit of priority from Japanese Patent Application No. 2021-158242, filed on Sep. 28, 2021; the entire contents of which are incorporated herein by reference.

FIELD

Embodiments described herein relate generally to a toilet device.

BACKGROUND

There is a toilet device to which an electric opening/closing unit is mounted to electrically open and close at least one of a toilet seat or a toilet lid. The electric opening/closing unit opens and closes the toilet seat or the toilet lid by the rotational force of a motor. A planetary gear mechanism that includes a carrier (a sun gear), a planetary gear, and an internal gear may be used as a transmission mechanism transmitting the rotational force of the motor in the electric opening/closing unit.

SUMMARY

According to the embodiment, a toilet device an electric opening/closing unit configured to open and close at least one of a toilet seat or a toilet lid. The electric opening/closing unit includes a motor and a transmission mechanism. The transmission mechanism transmits a rotation of the motor to one of the toilet seat or the toilet lid. The transmission mechanism includes an internal gear, a first transmission part and a second transmission part. The internal gear includes teeth provided in an inner circumferential surface of the internal gear. The internal gear is tubular. The first transmission part is housed in the internal gear. The first transmission part transmits a rotational force of the motor. The second transmission part is housed in the internal gear. The second transmission part transmits a rotational force of the first transmission part. The first transmission part includes a first planetary gear and a first planetary carrier. The rotational force of the motor is transmitted to the first planetary gear. The first planetary gear revolves around a rotation axis along the inner circumferential surface of the internal gear while rotating. The first planetary carrier rotates around the rotation axis as the first planetary gear rotates and revolves. The second transmission part includes a second planetary gear, a second planetary carrier and a shaft part. A rotational force of the first planetary carrier is transmitted to the second planetary gear. The second planetary gear revolves around the rotation axis along the inner circumferential surface of the internal gear while rotating. The second planetary carrier rotates around the rotation axis as the second planetary gear rotates and revolves. The shaft part includes a rotational axis of the second planetary gear. The shaft part revolves around the rotation axis. The first planetary carrier includes a protrusion extends along a trajectory of the revolution of the shaft part. The shaft part contacts the protrusion. A gap is formed between the shaft part and a part of the first planetary carrier other than the protrusion.

DETAILED DESCRIPTION

Figure 1:
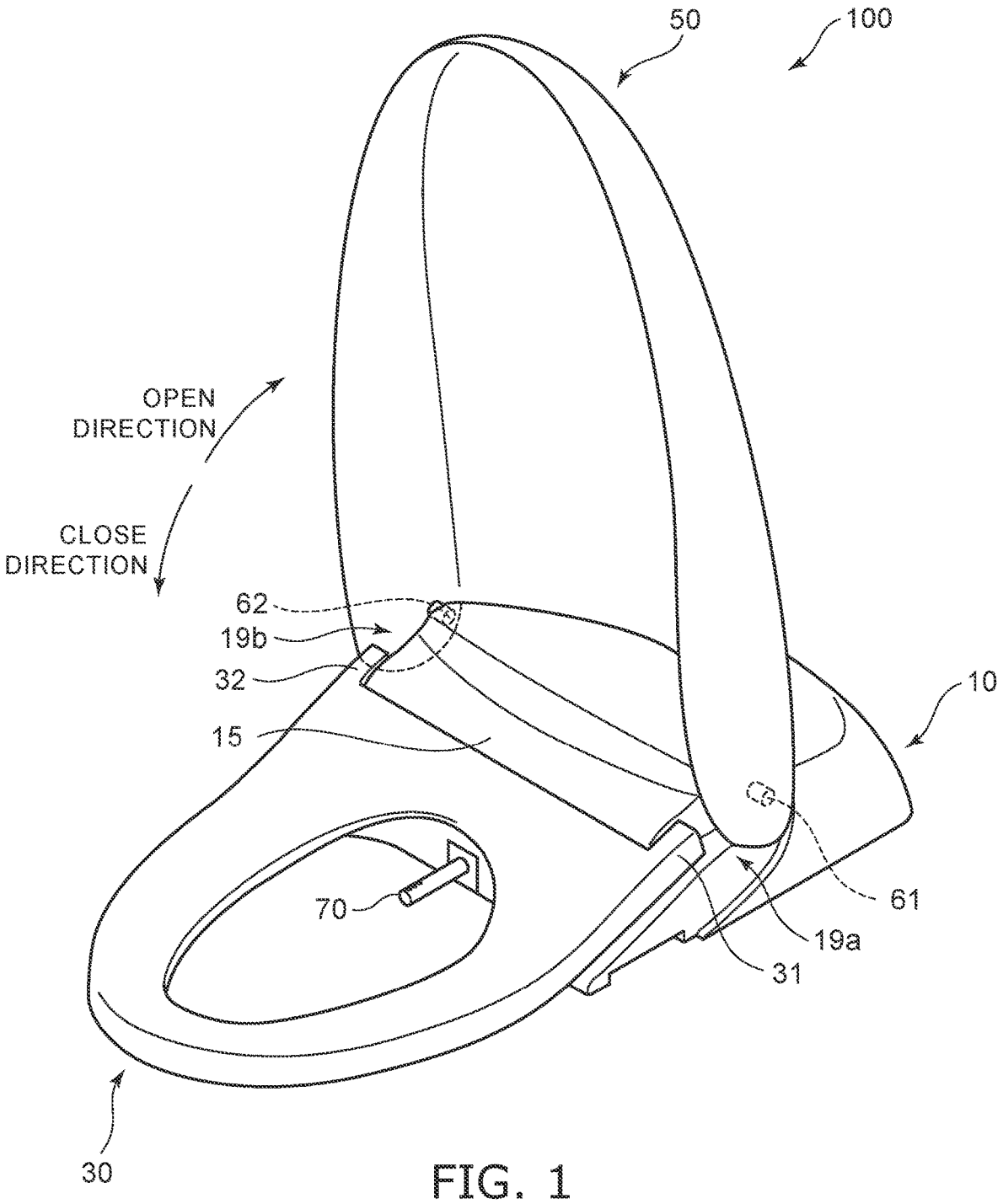
FIG. 1 is a perspective view illustrating a toilet device according to an embodiment.

A first invention is a toilet device including an electric opening/closing unit configured to open and close at least one of a toilet seat or a toilet lid; the electric opening/closing unit includes a motor, and a transmission mechanism transmitting a rotation of the motor to one of the toilet seat or the toilet lid; the transmission mechanism includes an internal gear that is tubular and includes teeth provided in an inner circumferential surface of the internal gear, a first transmission part that is housed in the internal gear and transmits a rotational force of the motor, and a second transmission part that is housed in the internal gear and transmits a rotational force of the first transmission part; the first transmission part includes a first planetary gear to which the rotational force of the motor is transmitted and that revolves around a rotation axis along the inner circumferential surface of the internal gear while rotating, and a first planetary carrier rotating around the rotation axis as the first planetary gear rotates and revolves; the second transmission part includes a second planetary gear to which a rotational force of the first planetary carrier is transmitted and that revolves around the rotation axis along the inner circumferential surface of the internal gear while rotating, a second planetary carrier rotating around the rotation axis as the second planetary gear rotates and revolves, and a shaft part that includes a rotational axis of the second planetary gear and revolves around the rotation axis; the first planetary carrier includes a protrusion extending along a trajectory of the revolution of the shaft part; the shaft part contacts the protrusion; and a gap is formed between the shaft part and a part of the first planetary carrier other than the protrusion.

According to the toilet device, the contact area between the first planetary carrier and the shaft part of the second planetary carrier can be reduced by providing the protrusion in the first planetary carrier. The sliding resistance between the first planetary carrier and the second planetary carrier can be reduced thereby. As a result, the rotational force can be efficiently transmitted.

A second invention is the toilet device of the first invention, wherein the protrusion includes a convex curved surface contacting the shaft part.

According to the toilet device, the convex curved surface of the protrusion can contact the shaft part of the second planetary carrier. The contact area between the protrusion provided in the first planetary carrier and the shaft part of the second planetary carrier can reduced thereby, and the sliding resistance can be further reduced.

A third invention is the toilet device of the first or second invention, wherein the shaft part includes a convex curved surface contacting the protrusion.

According to the toilet device, the convex curved surface of the shaft part can contact the protrusion of the first planetary carrier. The contact area between the protrusion provided in the first planetary carrier and the shaft part of the second planetary carrier can be reduced thereby, and the sliding resistance can be further reduced.

Exemplary embodiments will now be described with reference to the drawings. Similar components in the drawings are marked with like reference numerals; and a detailed description is omitted as appropriate.

FIG. 1 is a perspective view illustrating a toilet device according to an embodiment.

As illustrated in FIG. 1, the toilet device 100 (a toilet seat device) according to the embodiment includes a casing 10, a toilet seat 30 on which a user is seated, and a toilet lid 50 covering the toilet seat 30. The toilet seat 30 and the toilet lid 50 each are rotatably supported with respect to the casing 10. In other words, the toilet seat 30 and the toilet lid 50 each are pivotally supported to be openable and closeable. The state of FIG. 1 is the closed state (the lowered state) of the toilet seat 30 and the open state (the raised state) of the toilet lid 50. In the closed state, the toilet lid 50 covers the upper surfaces of the casing 10 and the toilet seat 30 from above.

A body wash functional unit that washes a human body private part (a "bottom" or the like) of the user sitting on the toilet seat 30, etc., are embedded inside the casing 10. For example, a washing nozzle 70, a control circuit that controls the operation of the washing nozzle 70, etc., are located inside the casing 10. When the user sits on the toilet seat 30, the washing nozzle 70 discharges wash water toward the private part of the user in a state of being advanced frontward from the interior of the casing 10. Various mechanisms such as a "warm air drying function" that dries the "bottom" or the like of the user sitting on the toilet seat 30 by blowing warm air, a "deodorizing unit", a "room heating unit", etc., may be provided in the casing 10 as appropriate.

As illustrated in FIG. 1, the casing 10 includes an upper surface 15. A pair of step parts (a first step part 19*a* and a second step part 19*b*) that is arranged in the lateral direction is provided at the front of the upper surface 15.

The toilet lid 50 includes a pair of toilet lid hinge parts (a first toilet lid hinge part 61 and a second toilet lid hinge part 62) arranged in the lateral direction. The toilet lid hinge parts are positioned inside the toilet lid. The first toilet lid hinge part 61 is located in the first step part 19*a*. The second toilet lid hinge part 62 is located in the second step part 19*b*. The toilet lid 50 is rotatably supported by the first toilet lid hinge part 61 and the second toilet lid hinge part 62. The toilet lid 50 is provided as necessary and is omissible.

The toilet seat 30 includes a pair of toilet seat hinge parts (a first toilet seat hinge part 31 and a second toilet seat hinge part 32) arranged in the lateral direction. The first toilet seat hinge part 31 is located in the first step part 19*a*. The second toilet seat hinge part 32 is located in the second step part 19*b*. The toilet seat 30 is rotatably supported by the first toilet seat hinge part 31 and the second toilet seat hinge part 32.

Figure 2:
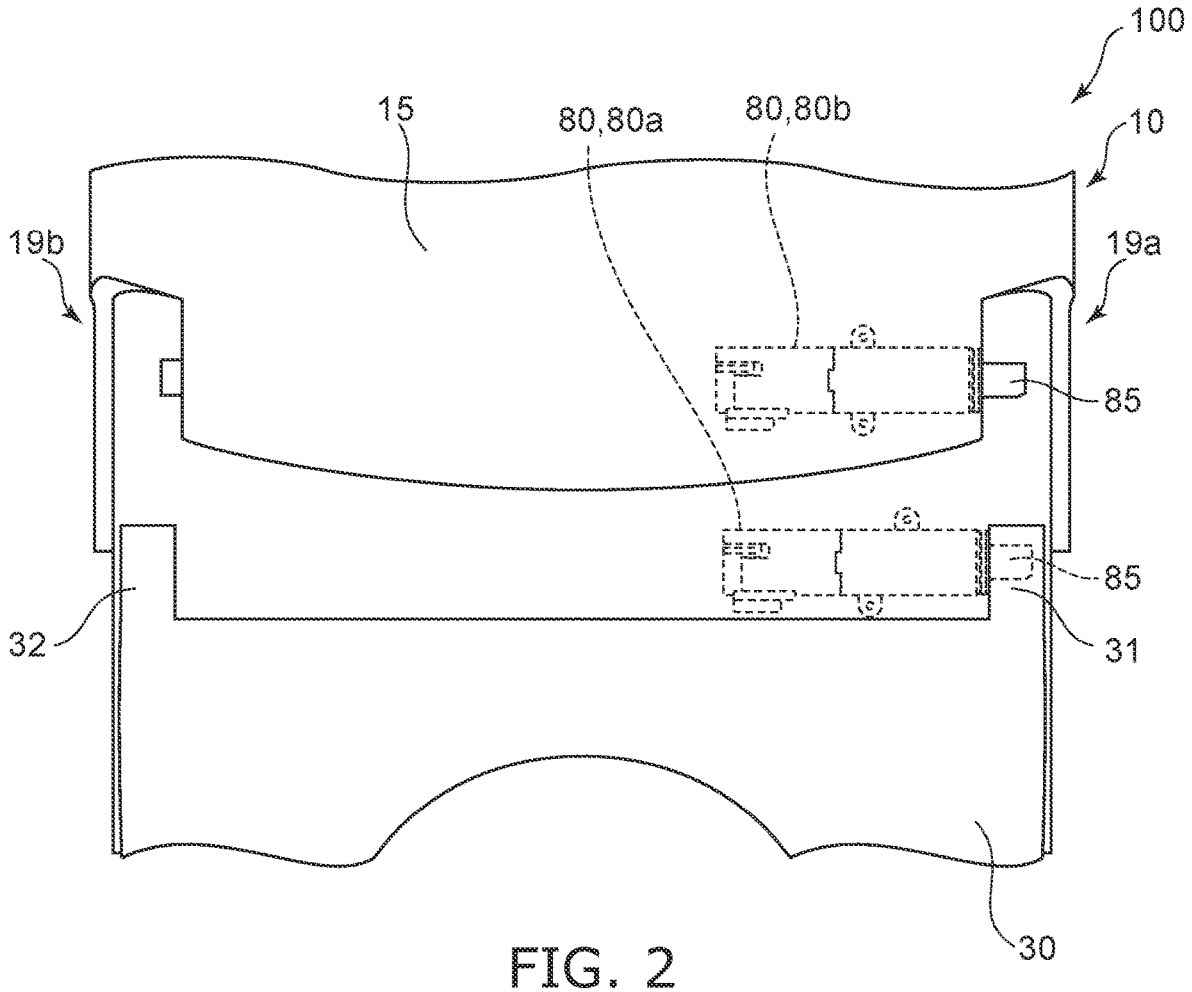
FIG. 2 is a plan view illustrating a part of the toilet device according to the embodiment.

FIG. 2 is a plan view illustrating a part of the toilet device according to the embodiment.

FIG. 2 shows the casing 10 when viewed from above with the toilet seat 30 in the closed state. The toilet lid 50 is not illustrated for easier viewing.

As illustrated in FIG. 2, the toilet device 100 includes an electric opening/closing unit 80 (an electric opening/closing device). The electric opening/closing unit 80 is configured to open and close at least one of the toilet seat 30 or the toilet lid 50. In the example, a toilet seat opening/closing unit 80*a* that is configured to open and close the toilet seat 30 and a toilet lid opening/closing unit 80*b* that is configured to open and close the toilet lid 50 are provided as the electric opening/closing units 80. At least a part of each electric opening/closing unit 80 is located inside the casing 10. The electric opening/closing unit 80 includes a driver such as a motor or the like and opens and closes the toilet seat 30 or the toilet lid 50 by the drive force of the driver. It is sufficient for the electric opening/closing unit 80 to include at least one of the toilet seat opening/closing unit 80*a* or the toilet lid opening/closing unit 80*b*. That is, one of the toilet seat opening/closing unit 80*a* or the toilet lid opening/closing unit 80*b* may be omitted.

For example, an output shaft 85 of the toilet seat opening/closing unit 80*a* protrudes from the side surface of the casing 10 at the first step part 19*a* and is directly or indirectly connected with the toilet seat 30. In the example, the output shaft 85 of the toilet seat opening/closing unit 80*a* engages the first toilet seat hinge part 31. The toilet seat opening/closing unit 80*a* rotates the toilet seat 30 by rotating the first toilet seat hinge part 31 by rotating the output shaft 85 with the torque of the motor. The toilet seat opening/closing unit 80*a* may be located at the second toilet seat hinge part 32 side.

Similarly, the output shaft 85 of the toilet lid opening/closing unit 80*b* protrudes from the side surface of the casing 10 at the first step part 19*a* and is directly or indirectly connected with the toilet lid 50. In the example, the output shaft 85 of the toilet lid opening/closing unit 80*b* engages the first toilet lid hinge part 61. The toilet lid opening/closing unit 80*b* rotates the toilet lid 50 by rotating the first toilet lid hinge part 61 by rotating the output shaft 85 with the torque of the motor. The toilet lid opening/closing unit 80*b* may be located at the second toilet lid hinge part 62 side.

Figure 3:
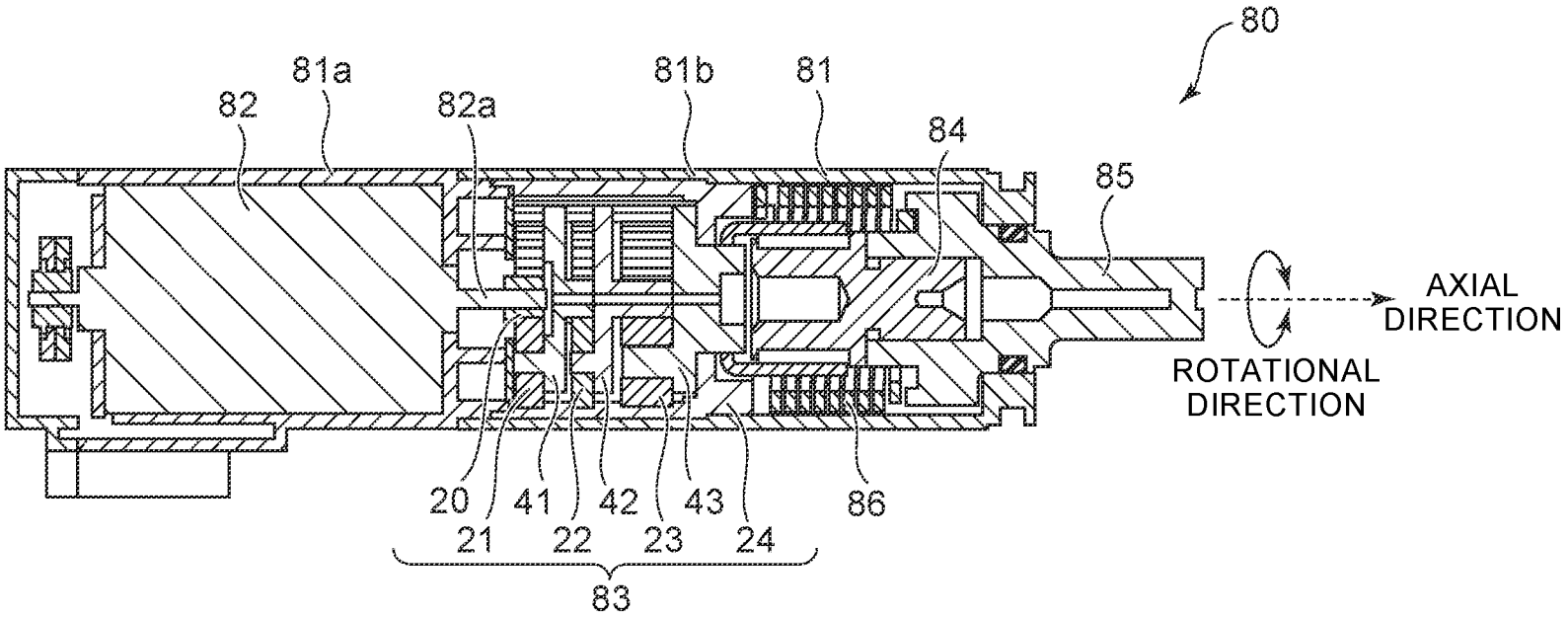
FIG. 3 is a cross-sectional view illustrating the electric opening/closing unit according to the embodiment.

FIG. 3 is a cross-sectional view illustrating the electric opening/closing unit according to the embodiment.

As illustrated in FIG. 3, the electric opening/closing unit 80 includes a case 81, a motor 82, a transmission mechanism 83, a shaft part 84, the output shaft 85, and a spring 86.

In the example, the case 81 includes a first case member 81*a* and a second case member 81*b*. The first case member 81*a* and the second case member 81*b* are combined to form the tubular case 81. Thus, the case 81 may be a combination of multiple members or may be formed from one member. The case 81 is fixed to the casing 10 by any fixing technique such as screws, bolts, etc.

The motor 82 is housed in the case 81. More specifically, at least a part of the motor 82 is housed in the first case member 81*a*; and a rotary shaft 82*a* of the motor 82 protrudes toward the second case member 81*b* side.

The transmission mechanism 83 is housed in the second case member 81*b* of the case 81. The transmission mechanism 83 is connected with the rotary shaft 82*a* of the motor 82 and directly or indirectly transmits the rotation of the motor 82 to the output shaft 85. In the example, the rotation of the motor 82 is transmitted to the output shaft 85 via the shaft part 84.

The transmission mechanism 83 is, for example, a speed reduction mechanism, and is a planetary gear mechanism in the example. The transmission mechanism 83 is described below more specifically with reference to FIGS. 4 and 5.

The shaft part 84 is housed in the second case member 81*b* of the case 81 and is directly or indirectly connected with a planetary carrier 43 of the transmission mechanism 83. The shaft part 84 rotates as the planetary carrier 43 rotates. The shaft part 84 may include, for example, a torque limiter.

At least a part of the output shaft 85 protrudes from the case 81. In the example, one end of the output shaft 85 protrudes from the second case member 81*b*; and the other end of the output shaft 85 is housed in the second case member 81*b* and connected with the shaft part 84. The output shaft 85 is rotatable with respect to the case 81 as the rotary shaft 82*a* of the motor 82 rotates. Thereby, the output shaft 85 outputs the rotational force of the motor 82 transmitted via the transmission mechanism 83 to the toilet seat 30 or the toilet lid 50. In other words, the electric opening/closing unit 80 opens and closes the toilet seat 30 or the toilet lid 50 by the rotation of the motor 82 transmitted to the output shaft 85.

The spring 86 is housed in the second case member 81*b* of the case 81. The spring 86 is, for example, a torsion coil spring. One end part of the spring 86 is connected to the transmission mechanism 83; and the other end part of the spring 86 is connected to the output shaft 85. The spring 86 urges the output shaft 85 in the rotational direction of the output shaft 85. That is, the elastic force of the spring 86 is transmitted to the toilet seat 30 or the toilet lid 50 via the output shaft 85. For example, the spring 86 urges the toilet seat 30 or the toilet lid 50 in the open direction. By providing the spring 86, the opening and closing of the toilet seat 30 and/or the toilet lid 50 can be assisted.

The shaft part 84 is located inside the spring 86. For example, the rotary shaft 82*a* of the motor 82, the planetary carriers (the sun gears) of the transmission mechanism 83, the shaft part 84, the output shaft 85, and the center axes (the rotation axes) of the spring 86 match each other. The center axes (the rotation axes) being matched may include not only cases where the center axis is positioned exactly on a straight line but also, for example, slight deviation within the range of manufacturing fluctuation, play in the design, etc. For example, the spring 86 is located not to contact the members (the case 81) outside the spring 86 and the members (the shaft part 84) inside the spring 86.

Figure 4:
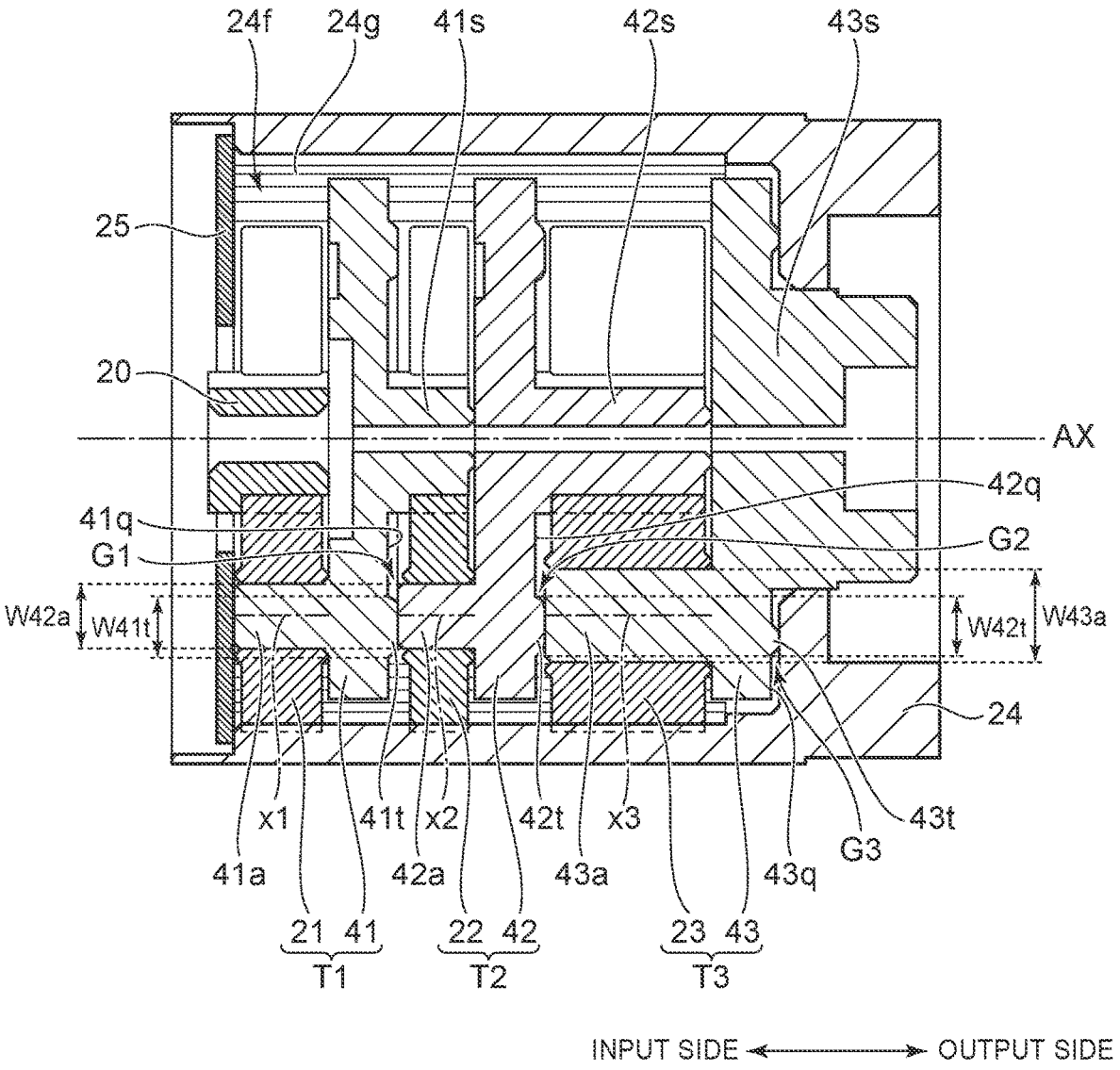
FIG. 4 is a cross-sectional view illustrating the transmission mechanism of the electric opening/closing unit according to the embodiment.

FIG. 4 is a cross-sectional view illustrating the transmission mechanism of the electric opening/closing unit according to the embodiment.

Figure 5:
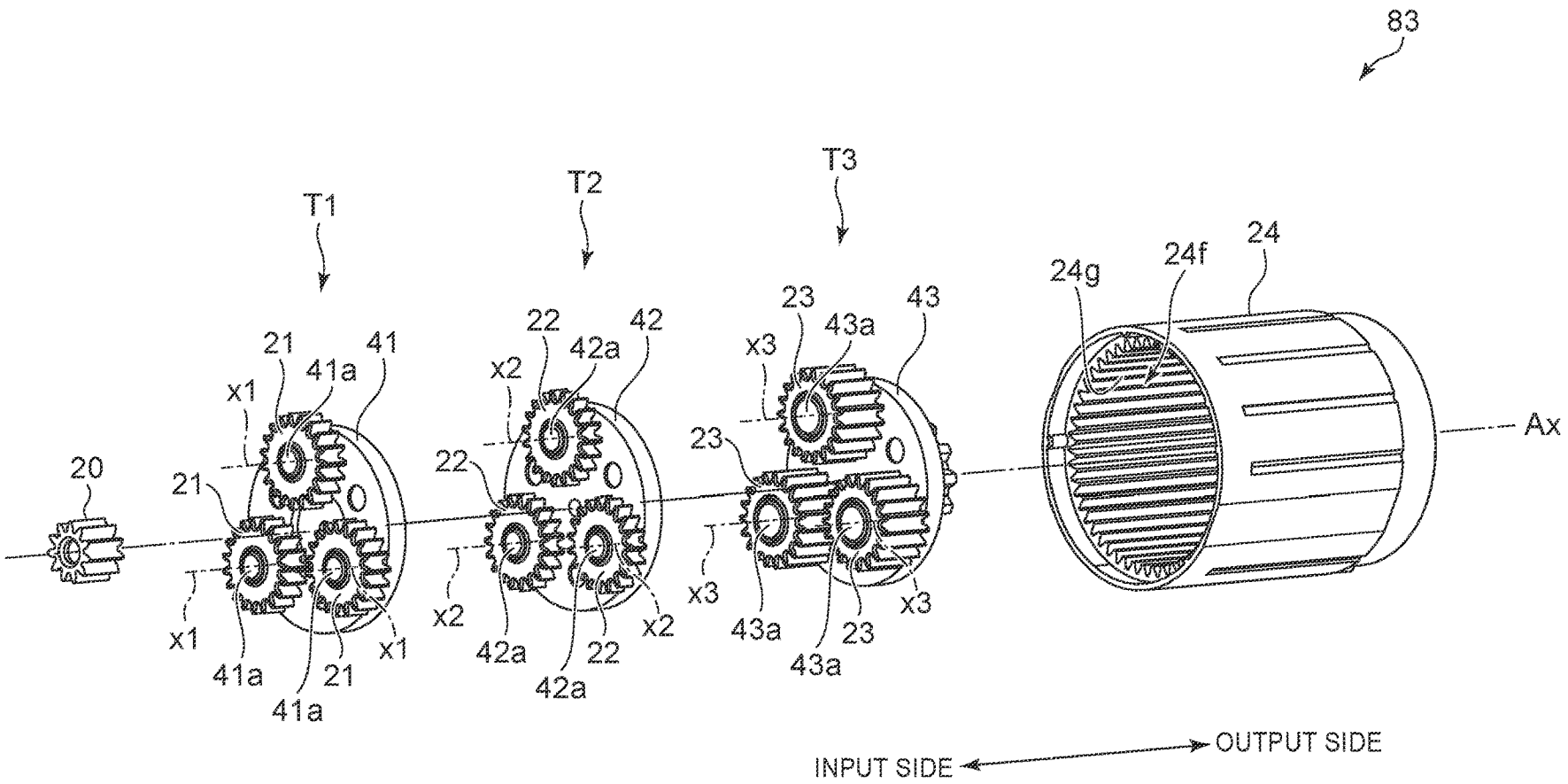
FIG. 5 is an exploded view illustrating the transmission mechanism of the electric opening/closing unit according to the embodiment.

FIG. 5 is an exploded view illustrating the transmission mechanism of the electric opening/closing unit according to the embodiment.

As illustrated in FIGS. 4 and 5, the transmission mechanism 83 includes a sun gear 20, a transmission part T1 (e.g., a first transmission part), a transmission part T2 (e.g., a second transmission part), a transmission part T3 (e.g., a third transmission part), and an internal gear 24 (a case). The sun gear 20 and the transmission parts T1, T2, and T3 are housed inside the internal gear 24. A plate-shaped case member 25 also is included as illustrated in FIG. 4.

The transmission part T1 includes a planetary gear 21 (e.g., a first planetary gear) and a planetary carrier 41 (e.g., a first planetary carrier) that engages the planetary gear 21. The transmission part T1 transmits the rotational force of the motor 82 to the transmission part T2.

The transmission part T2 includes a planetary gear 22 (e.g., a second planetary gear) and a planetary carrier 42 (e.g., a second planetary carrier) that engages the planetary gear 22. The transmission part T2 transmits the rotational force of the transmission part T1 to the transmission part T3.

The transmission part T3 includes a planetary gear 23 (e.g., a third planetary gear) and a planetary carrier 43 (e.g., a third planetary carrier) that engages the planetary gear 23. The transmission part T3 transmits the rotational force of the transmission part T2 to the output shaft 85 via the shaft part 84.

The transmission of the rotation (the force) may include not only cases where a member directly transmits the force by direct contact but also cases where the force is indirectly transmitted via another member located between the members.

The internal gear 24 is tubular (circular tubular); and teeth 24*g* that engage the planetary gears 21, 22, and 23 are provided in an inner circumferential surface 24*f* of the internal gear 24. In the example, the internal gear 24 is a member that is relatively fixed to the case 81 and is not rotated even when the output shaft 85 is rotated by the rotary shaft 82*a* of the motor 82. The sun gear 20, the planetary gear 21, the planetary carrier 41, the planetary gear 22, the planetary carrier 42, the planetary gear 23, and the planetary carrier 43 are housed inside the internal gear 24.

The sun gear 20 engages the rotary shaft 82*a* of the motor 82. Thereby, the rotational force of the motor 82 is transmitted to the sun gear 20. The sun gear 20 rotates around a rotation axis Ax as the motor 82 rotates. The rotation axis Ax is an axis that matches the rotary shaft of the motor 82.

In the example, three planetary gears 21 are located around the sun gear 20. The planetary gears 21 engage the sun gear 20. Therefore, the rotational force of the sun gear 20, i.e., the rotational force of the motor, is transmitted to the planetary gears 21. As described above, the planetary gears 21 engage the teeth 24*g* of the internal gear 24. Thereby, the planetary gears 21 revolve around the rotation axis Ax along the inner circumferential surface 24*f* of the internal gear 24 while rotating as the motor 82 rotates.

The planetary carrier 41 performs the roles of the rotational axis of the planetary gear 21 and the sun gear for the planetary gear 22 of the subsequent stage. Specifically, the planetary carrier 41 includes a shaft part 41*a* and a sun gear part 41*s* (see FIG. 4). The shaft part 41*a* extends through and supports the planetary gear 21. The planetary gear 21 is rotatable with respect to the shaft part 41*a*. In other words, the shaft part 41*a* includes a rotational axis x1 of the planetary gear 21; and the planetary gear 21 can rotate around the shaft part 41*a* (the rotational axis x1). The direction of the rotational axis x1 (the direction in which the shaft part 41*a* extends) is substantially parallel to the rotation axis Ax. In the example, three shaft parts 41*a* are included, and the planetary gear 21 is mounted to each shaft part 41*a*. The rotational force of the planetary gear 21 is transmitted to the shaft part 41*a*. In other words, the shaft part 41*a* revolves around the rotation axis Ax as the planetary gear 21 rotates and revolves. Thereby, the planetary carrier 41 rotates around the rotation axis Ax. In other words, the sun gear part 41*s* rotates around the rotation axis Ax.

In the example, three planetary gears 22 are located around the sun gear part 41*s*. The planetary gears 22 engage the sun gear part 41*s*. Therefore, the rotational force of the planetary carrier 41 is transmitted to the planetary gears 22. As described above, the planetary gears 22 engage the teeth 24*g* of the internal gear 24. Thereby, the planetary gears 22 revolve around the rotation axis Ax along the inner circumferential surface 24*f* of the internal gear 24 while rotating as the planetary carrier 41 rotates.

The planetary carrier 42 performs the roles of the rotational axis of the planetary gear 22 and the sun gear for the planetary gear 23 of the subsequent stage. Specifically, the planetary carrier 42 includes a shaft part 42*a* and a sun gear part 42*s* (see FIG. 4). The shaft part 42*a* extends through and supports the planetary gear 22. The planetary gear 22 is rotatable with respect to the shaft part 42*a*. In other words, the shaft part 42*a* includes a rotational axis x2 of the planetary gear 22; and the planetary gear 22 can rotate around the shaft part 42*a* (the rotational axis x2). The direction of the rotational axis x2 (the direction in which the shaft part 42*a* extends) is substantially parallel to the rotation axis Ax. In the example, three shaft parts 42*a* are included; and the planetary gear 22 is mounted to each shaft part 42*a*. The rotational force of the planetary gear 22 is transmitted to the shaft part 42*a*. In other words, the shaft part 42*a* revolves around the rotation axis Ax as the planetary gear 22 rotates and revolves. Thereby, the planetary carrier 42 rotates around the rotation axis Ax. In other words, the sun gear part 42*s* rotates around the rotation axis Ax.

In the example, three planetary gears 23 are located around the sun gear part 42*s*. The planetary gears 23 engage the sun gear part 42*s*. Therefore, the rotational force of the planetary carrier 42 is transmitted to the planetary gears 23. As described above, the planetary gears 23 engage the teeth 24*g* of the internal gear 24. Thereby, the planetary gears 23 revolve around the rotation axis Ax along the inner circumferential surface 24*f* of the internal gear 24 while rotating as the planetary carrier 42 rotates.

The planetary carrier 43 performs the roles of the rotational axis of the planetary gear 23 and a gear that engages the shaft part 84 of the subsequent stage. Specifically, the planetary carrier 43 includes a shaft part 43*a* and a gear part 43*s* (see FIG. 4). The shaft part 43*a* extends through and supports the planetary gear 23. The planetary gear 23 is rotatable with respect to the shaft part 43*a*. In other words, the shaft part 43*a* includes a rotational axis x3 of the planetary gear 23; and the planetary gear 23 can rotate around the shaft part 43*a* (the rotational axis x3). The direction of the rotational axis x3 (the direction in which the shaft part 43*a* extends) is substantially parallel to the rotation axis Ax. In the example, three shaft parts 43*a* are included, and the planetary gear 23 is mounted to each shaft part 43*a*. The rotational force of the planetary gear 23 is transmitted to the shaft part 43*a*. In other words, the shaft part 43*a* revolves around the rotation axis Ax as the planetary gear 23 rotates and revolves. Thereby, the planetary carrier 43 rotates around the rotation axis Ax. In other words, the gear part 43*s* rotates around the rotation axis Ax.

The gear part 43*s* engages the shaft part 84. Thereby, the rotational force of the planetary carrier 43 is transmitted to the shaft part 84.

Details of the members of the transmission parts T1, T2, and T3 will now be described.

Figure 6A:
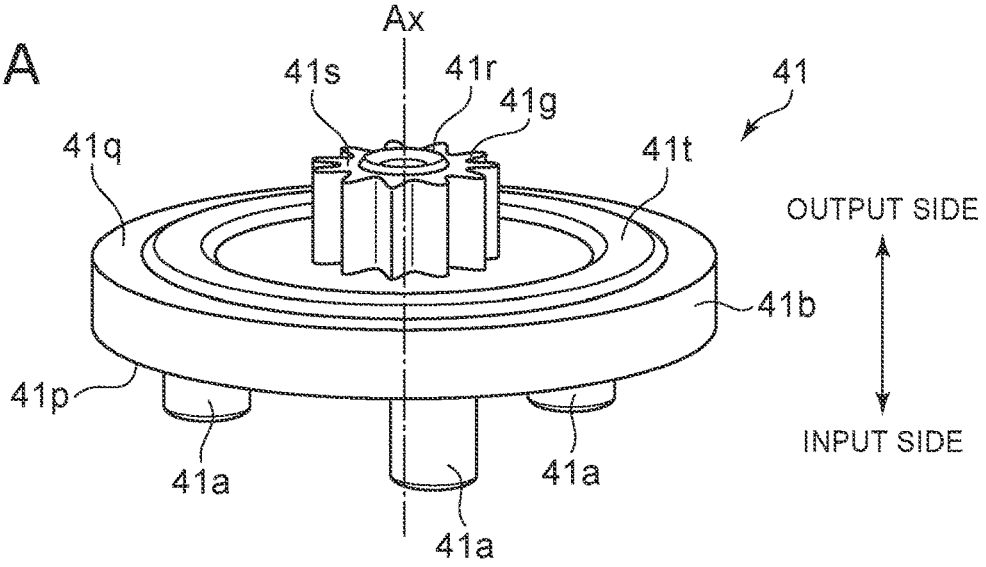
FIGS. 6A to 6C are a perspective view and plan views illustrating the planetary carrier of the electric opening/closing unit according to the embodiment.
Figure 6B:
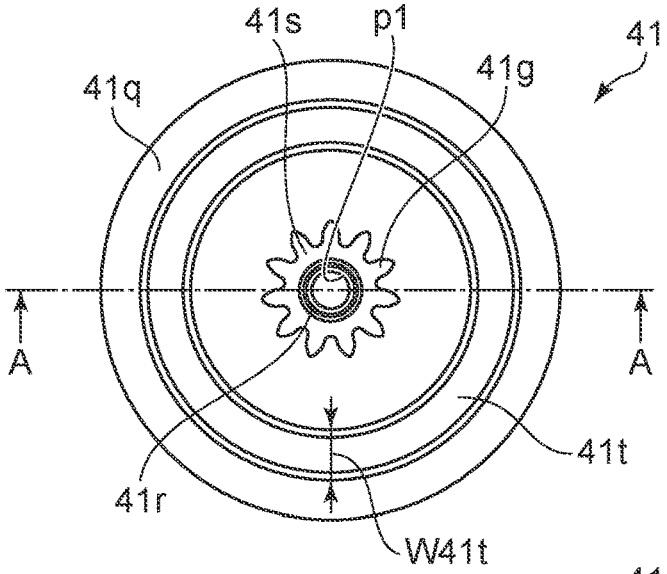
Figure 6C:
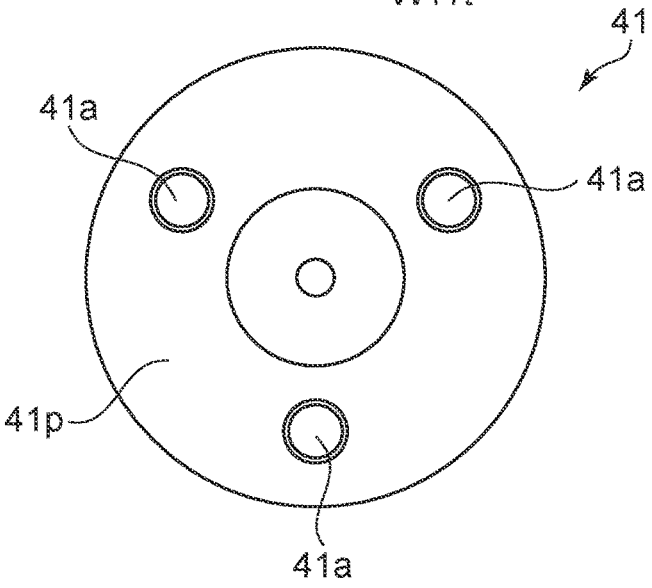

Transmission part T1 FIGS. 6A to 6C are a perspective view and plan views illustrating the planetary carrier of the electric opening/closing unit according to the embodiment.

Figure 7:
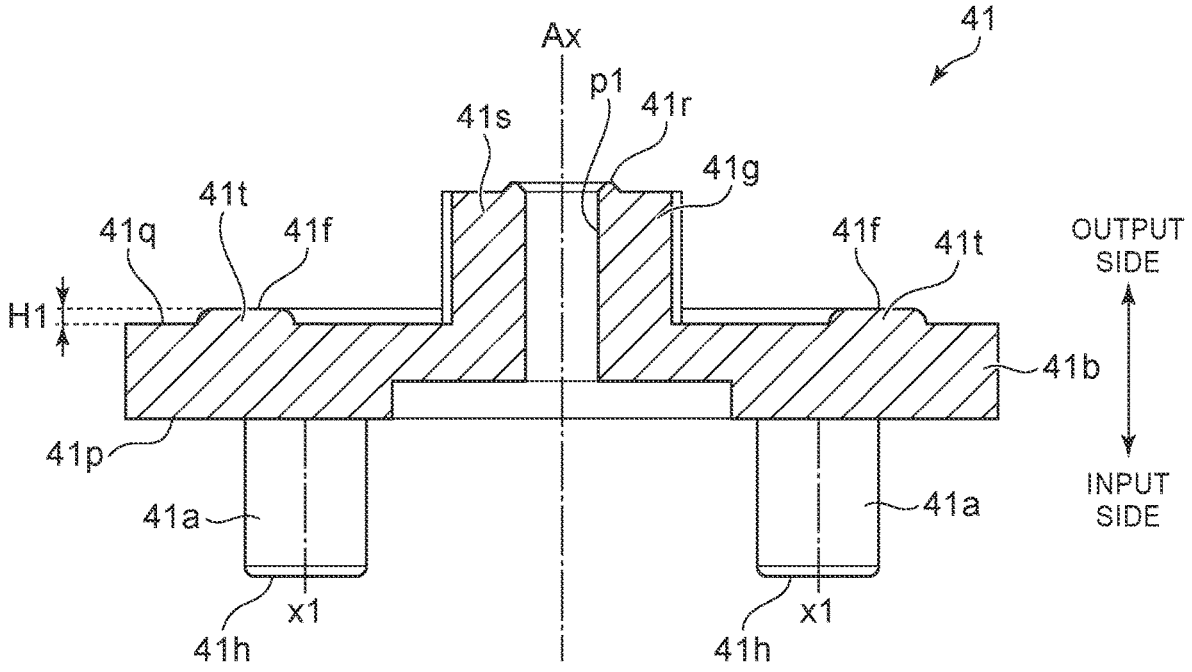
FIG. 7 is a cross-sectional view illustrating the planetary carrier of the electric opening/closing unit according to the embodiment.

FIG. 7 is a cross-sectional view illustrating the planetary carrier of the electric opening/closing unit according to the embodiment. FIG. 6A is a perspective view of the planetary carrier 41; FIG. 6B is a plan view of the planetary carrier 41 when viewed from the output side; and FIG. 6C is a plan view of the planetary carrier 41 when viewed from the input side. The output side is the direction of the output shaft 85 when viewed from the transmission mechanism 83; and the input side is the direction of the motor 82 when viewed from the transmission mechanism 83. FIG. 7 is a cross section of line A-A shown in FIG. 6B.

The planetary carrier 41 includes a base 41*b*. The base 41*b* is, for example, discal. The base 41*b* includes an input-side surface 41*p*, and an output-side surface 41*q* at the side opposite to the input-side surface 41*p*. The input-side surface 41*p* and the output-side surface 41*q* extend along a plane perpendicular to the rotation axis Ax and are circular when viewed in plan. However, the base 41*b* may not always be circular when viewed in plan.

The shaft part 41*a* extends toward the input side from the input-side surface 41*p* of the base 41*b*. The shaft part 41*a* is cylindrical. The shapes of the multiple shaft parts 41*a* are the same. As illustrated in FIG. 6C, the multiple shaft parts 41*a* are arranged isotropically (i.e., about every 120°) when viewed from the rotation axis Ax. For example, as illustrated in FIG. 7, the center axis of the shaft part 41*a* corresponds to the rotational axis x1 of the planetary gear 21.

The sun gear part 41*s* extends toward the output side from the output-side surface 41*q* of the base 41*b*. Multiple teeth 41*g* that protrude in directions perpendicular to the rotation axis Ax are provided in the sun gear part 41*s*. For example, as illustrated in FIG. 7, a through-hole p1 is provided in the planetary carrier 41. The through-hole p1 extends in a direction parallel to the rotation axis Ax and extends through the centers of the base 41*b* and the sun gear part 41*s*. A circular protrusion 41*r* that surrounds the periphery of the through-hole p1 is located at the end part of the sun gear part 41*s* at the output side.

The planetary carrier 41 also includes a protrusion 41*t* protruding toward the output side from the output-side surface 41*q*. The protrusion 41*t* extends along the trajectory of the revolution of the shaft part 42*a* of the planetary carrier 42. In other words, the protrusion 41*t* is a circular rib that is equivalent to the circumference along which the shaft part 42*a* revolves around the rotation axis Ax. For example, at least a part of the protrusion 41*t* overlaps at least a part of the trajectory of the revolution of the shaft part 42*a* of the planetary carrier 42 in the direction in which the rotation axis Ax extends. The center position of the circular protrusion 41*t* matches the position of the rotation axis Ax. The protrusion 41*t* is, for example, a bearing of the shaft part 42*a*.

Figure 8A:
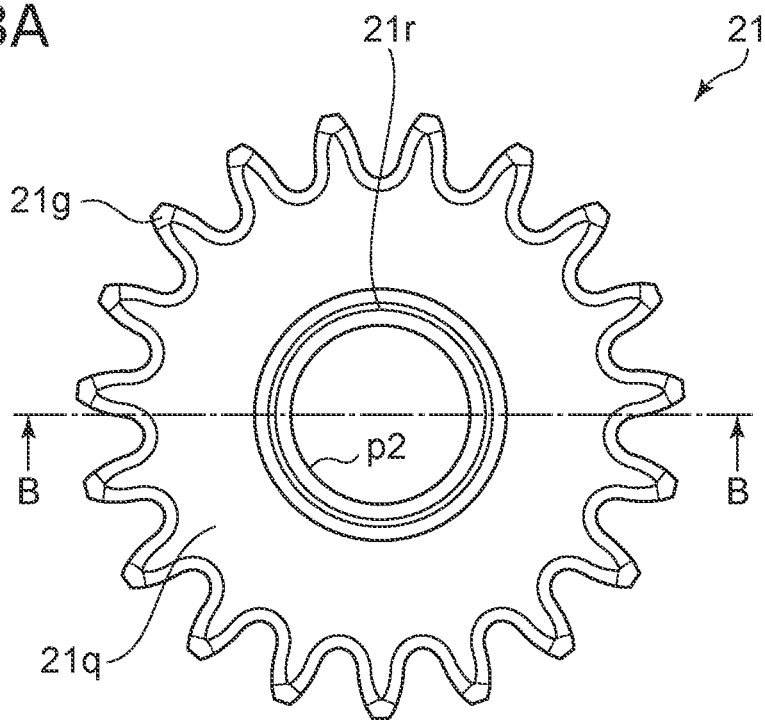
FIGS. 8A and 8B are a plan view and a cross-sectional view illustrating a planetary gear of the electric opening/closing unit according to the embodiment.
Figure 8B:
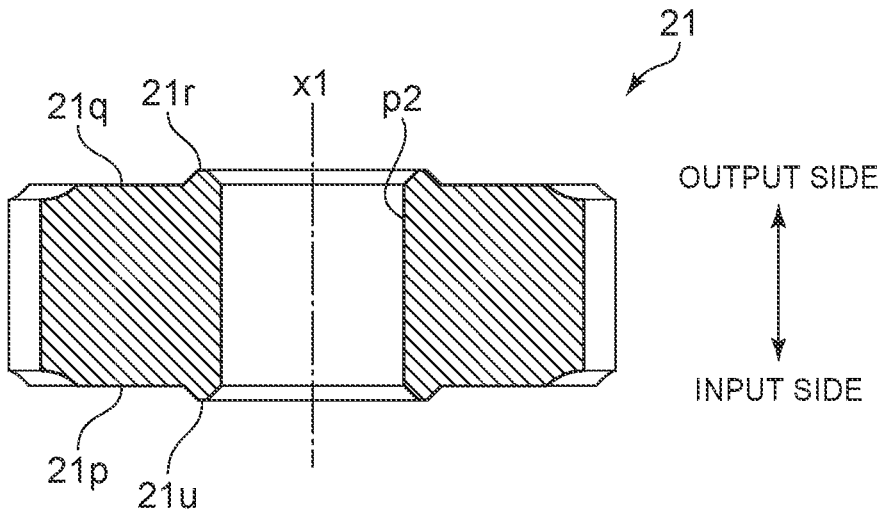

FIGS. 8A and 8B are a plan view and a cross-sectional view illustrating a planetary gear of the electric opening/closing unit according to the embodiment.

FIG. 8A is a plan view of the planetary gear 21 when viewed from the output side; and FIG. 8B is a cross section of line B-B shown in FIG. 8A.

The planetary gear 21 is substantially circular discal when viewed in plan; and multiple teeth 21*g* that protrude in directions perpendicular to the rotational axis x1 are provided in the outer circumference of the planetary gear 21. A through-hole p2 is provided in the planetary gear 21. The through-hole p2 extends in a direction parallel to the rotational axis x1 and extends through the center of the planetary gear 21. The shaft part 41*a* is inserted into the through-hole p2.

A circular protrusion 21*r* is located at an output-side surface 21*q* of the planetary gear 21. The protrusion 21*r* surrounds the periphery of the through-hole p2. The contact area between the planetary gear 21 and the planetary carrier 41 can be reduced by providing the protrusion 21*r*. Similarly, a circular protrusion 21*u* is located at an input-side surface 21*p* of the planetary gear 21. The protrusion 21*u* surrounds the periphery of the through-hole p2. The contact area between the planetary gear 21 and the case member 25 can be reduced by providing the protrusion 21*u*.

In the example as described above, the shaft part 41*a* and/or the sun gear part 41*s* are a part of the planetary carrier 41. For example, the shaft part 41*a* and the sun gear part 41*s* are molded as a continuous body with the base 41*b* of the planetary carrier 41. However, the configuration is not limited thereto; the shaft part 41*a* and/or the sun gear part 41*s* may be separate from the base 41*b* and may be combined as appropriate. It is sufficient for the shaft part 41*a* to be connected to the planetary gear 21 and for the planetary gear 21 to be rotatable with the shaft part 41*a* as the rotational axis. It is therefore sufficient for the rotational force of the planetary gear 21 to be transmitted to the sun gear part 41*s*. For example, the shaft part 41*a* may be fixed as a continuous body with the planetary gear 21 and may be rotatably connected with respect to the base 41*b*.

Transmission Part T2

Figure 9A:
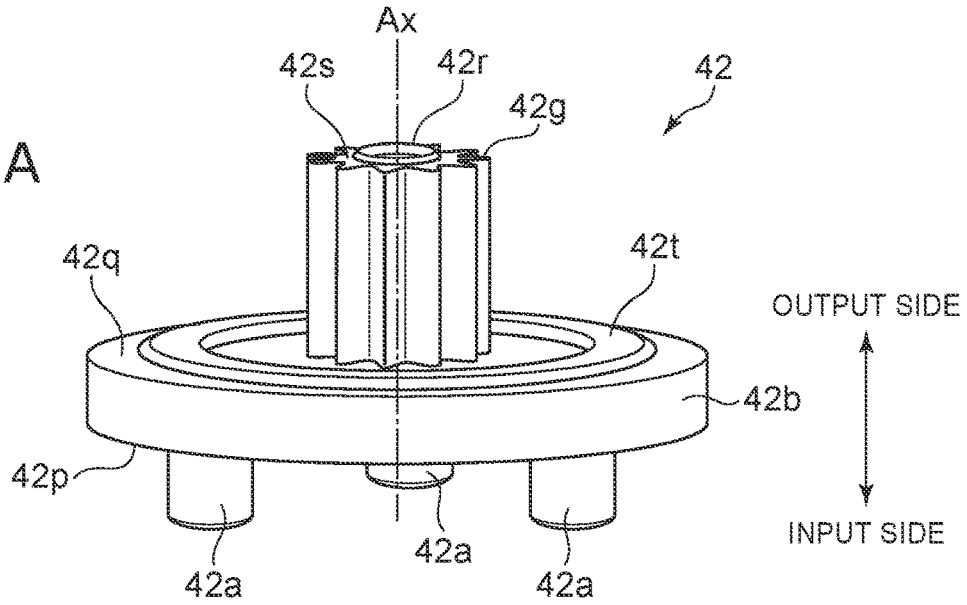
FIGS. 9A to 9C are a perspective view and a plan view illustrating the planetary carrier of the electric opening/closing unit according to the embodiment.
Figure 9B:
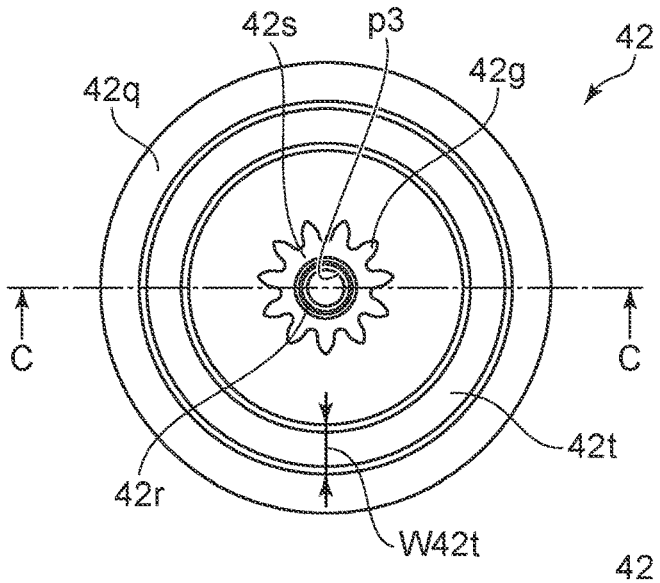
Figure 9C:
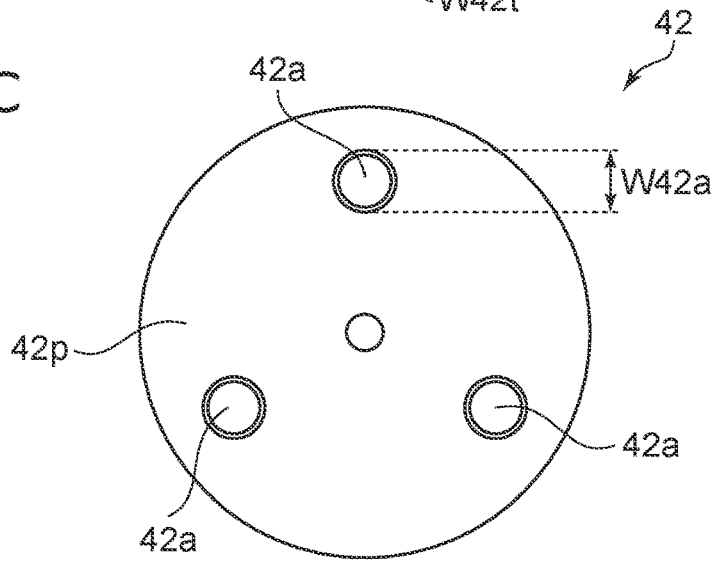

FIGS. 9A to 9C are a perspective view and a plan view illustrating the planetary carrier of the electric opening/closing unit according to the embodiment.

Figure 10:
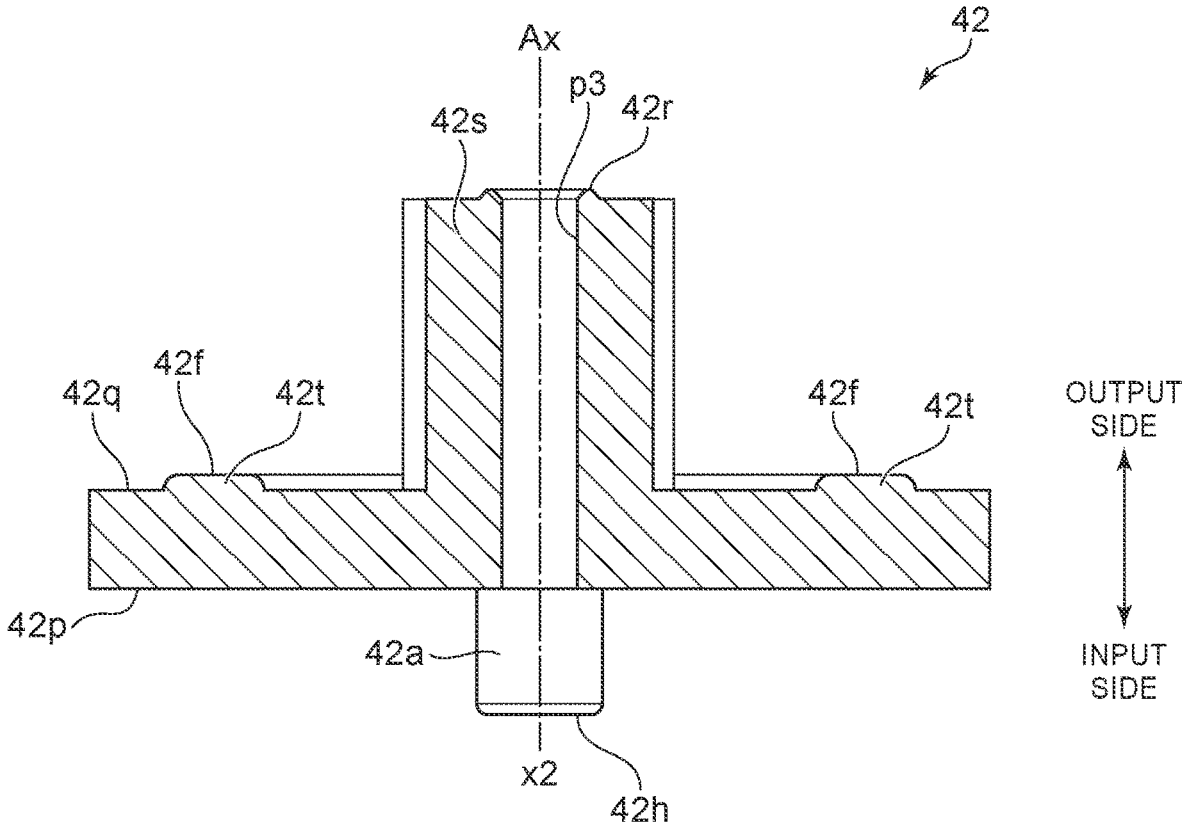
FIG. 10 is a cross-sectional view illustrating the planetary carrier of the electric opening/closing unit according to the embodiment.

FIG. 10 is a cross-sectional view illustrating the planetary carrier of the electric opening/closing unit according to the embodiment. FIG. 9A is a perspective view of the planetary carrier 42; FIG. 9B is a plan view of the planetary carrier 42 when viewed from the output side; and FIG. 9C is a plan view of the planetary carrier 42 when viewed from the input side. FIG. 10 is a cross section of line C-C shown in FIG. 9B.

The planetary carrier 42 includes a base 42*b*. The base 42*b* is, for example, discal. The base 42*b* includes an input-side surface 42*p*, and an output-side surface 42*q* at the side opposite to the input-side surface 42*p*. The input-side surface 42*p* and the output-side surface 42*q* extend along a plane perpendicular to the rotation axis Ax and are circular when viewed in plan. However, the base 42*b* may not always be circular when viewed in plan.

The shaft part 42*a* extends toward the input side from the input-side surface 42*p* of the base 42*b*. The shaft part 42*a* is cylindrical. The shapes of the multiple shaft parts 42*a* are the same. As illustrated in FIG. 9C, the multiple shaft parts 42*a* are arranged isotropically (i.e., about every 120°) when viewed from the rotation axis Ax. For example, as illustrated in FIG. 10, the center axis of the shaft part 42*a* corresponds to the rotational axis x2 of the planetary gear 22.

The sun gear part 42*s* extends toward the output side from the output-side surface 42*q* of the base 42*b*. Multiple teeth 42*g* that protrude in directions perpendicular to the rotation axis Ax are provided in the sun gear part 42*s*. For example, as illustrated in FIG. 10, a through-hole p3 is provided in the planetary carrier 42. The through-hole p3 extends in a direction parallel to the rotation axis Ax and extends through the centers of the base 42*b* and the sun gear part 42*s*. A circular protrusion 42*r* that surrounds the periphery of the through-hole p3 is located at the end part of the sun gear part 42*s* at the output side.

The planetary carrier 42 also includes a protrusion 42*t* that protrudes toward the output side from the output-side surface 42*q*. The protrusion 42*t* extends along the trajectory of the revolution of the shaft part 43*a* of the planetary carrier 43. In other words, the protrusion 42*t* is a circular rib that is equivalent to the circumference along which the shaft part 43*a* revolves around the rotation axis Ax. For example, at least a part of the protrusion 42*t* overlaps at least a part of the trajectory of the revolution of the shaft part 43*a* of the planetary carrier 43 in the direction in which the rotation axis Ax extends. The center position of the circular protrusion 42*t* matches the position of the rotation axis Ax. The protrusion 42*t* is, for example, a bearing of the shaft part 43*a*.

Figure 11A:
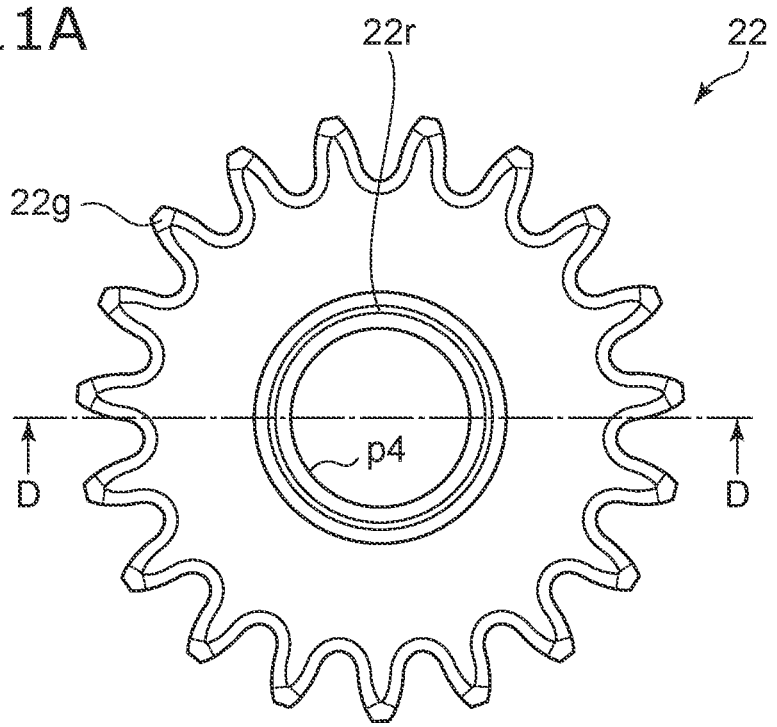
FIGS. 11A and 11B are a plan view and a cross-sectional view illustrating the planetary gear of the electric opening/closing unit according to the embodiment.
Figure 11B:
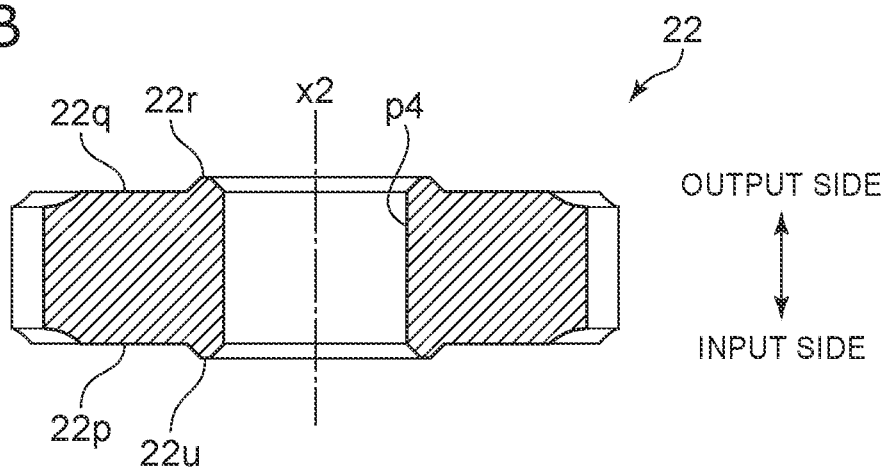

FIGS. 11A and 11B are a plan view and a cross-sectional view illustrating the planetary gear of the electric opening/closing unit according to the embodiment.

FIG. 11A is a plan view of the planetary gear 22 when viewed from the output side; and FIG. 11B is a cross section of line D-D shown in FIG. 11A.

The planetary gear 22 is substantially circular discal when viewed in plan; and multiple teeth 22*g* that protrude in directions perpendicular to the rotational axis x2 are provided in the outer circumference of the planetary gear 22. A through-hole p4 is provided in the planetary gear 22. The through-hole p4 extends in the direction parallel to the rotational axis x2 and extends through the center of the planetary gear 22. The shaft part 42*a* is inserted into the through-hole p4.

A circular protrusion 22*r* is located at an output-side surface 22*q* of the planetary gear 22. The protrusion 22*r* surrounds the periphery of the through-hole p4. The contact area between the planetary gear 22 and the planetary carrier 42 can be reduced by providing the protrusion 22*r*. Similarly, a circular protrusion 22*u* is located at an input-side surface 22*p* of the planetary gear 22. The protrusion 22*u* surrounds the periphery of the through-hole p4. The contact area between the planetary gear 22 and the planetary carrier 41 can be reduced by providing the protrusion 22*u*.

In the example as described above, the shaft part 42*a* and/or the sun gear part 42*s* are a part of the planetary carrier 42. For example, the shaft part 42*a* and the sun gear part 42*s* are molded as a continuous body with the base 42*b* of the planetary carrier 42. However, the configuration is not limited thereto; the shaft part 42*a* and/or the sun gear part 42*s* may be separate from the base 42*b* and may be combined as appropriate. It is sufficient for the shaft part 42*a* to be connected to the planetary gear 22 and for the planetary gear 22 to be rotatable with the shaft part 42*a* as the rotational axis. It is therefore sufficient for the rotational force of the planetary gear 22 to be transmitted to the sun gear part 42*s*. For example, the shaft part 42*a* may be fixed as a continuous body with the planetary gear 22 and may be rotatably connected with respect to the base 42*b*.

Transmission Part T3

Figure 12A:
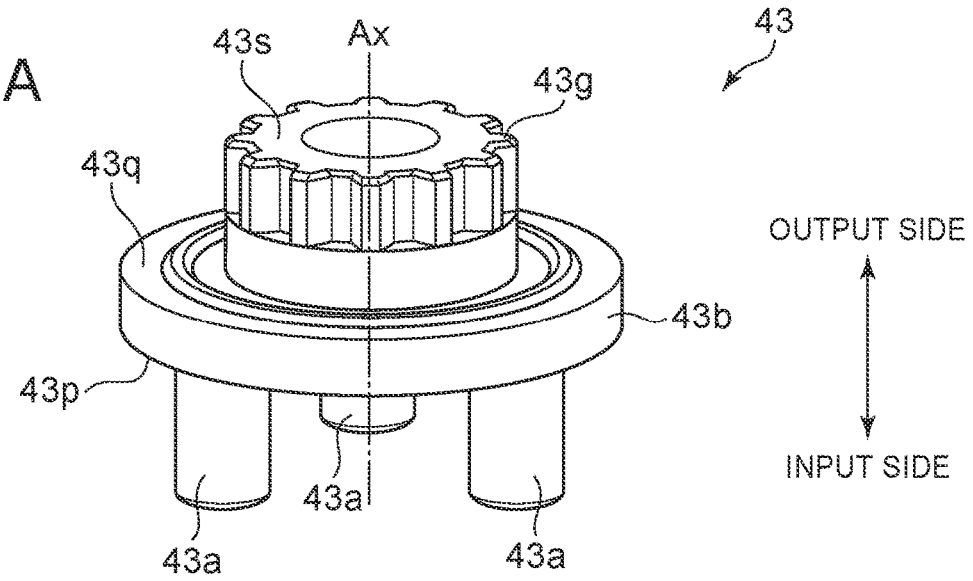
FIGS. 12A to 12C are a perspective view and a plan view illustrating the planetary carrier of the electric opening/closing unit according to the embodiment.
Figure 12B:
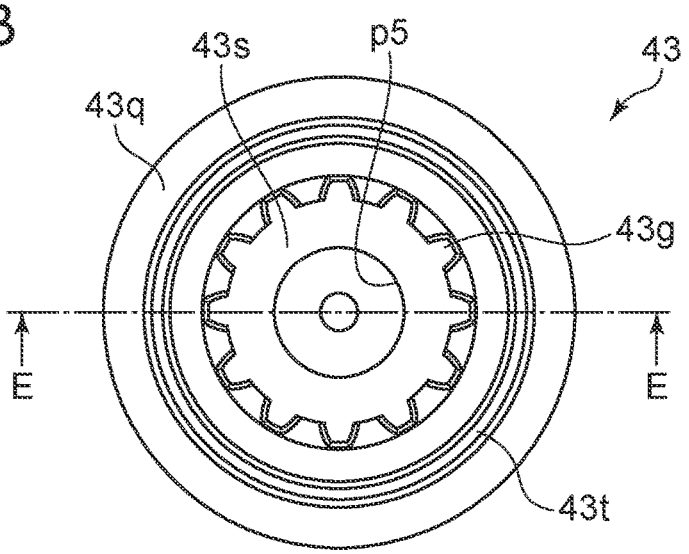
Figure 12C:
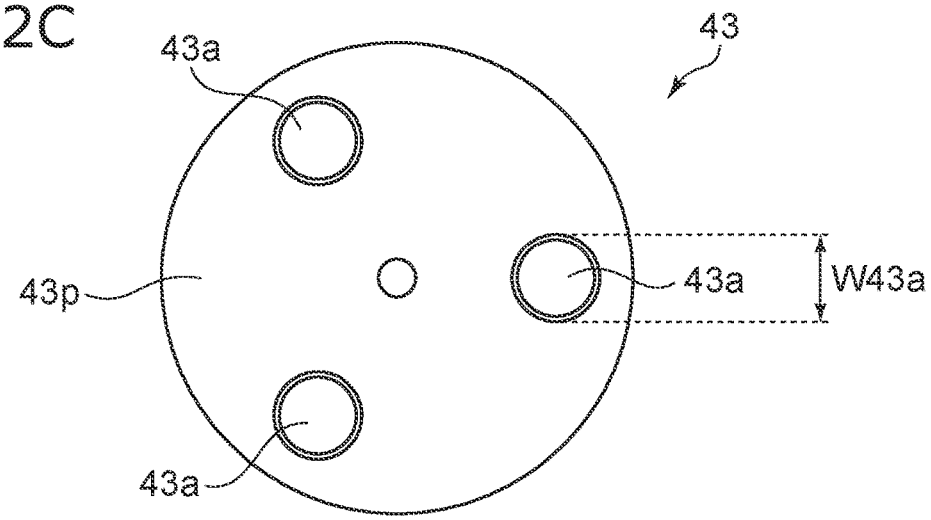

FIGS. 12A to 12C are a perspective view and a plan view illustrating the planetary carrier of the electric opening/closing unit according to the embodiment.

Figure 13:
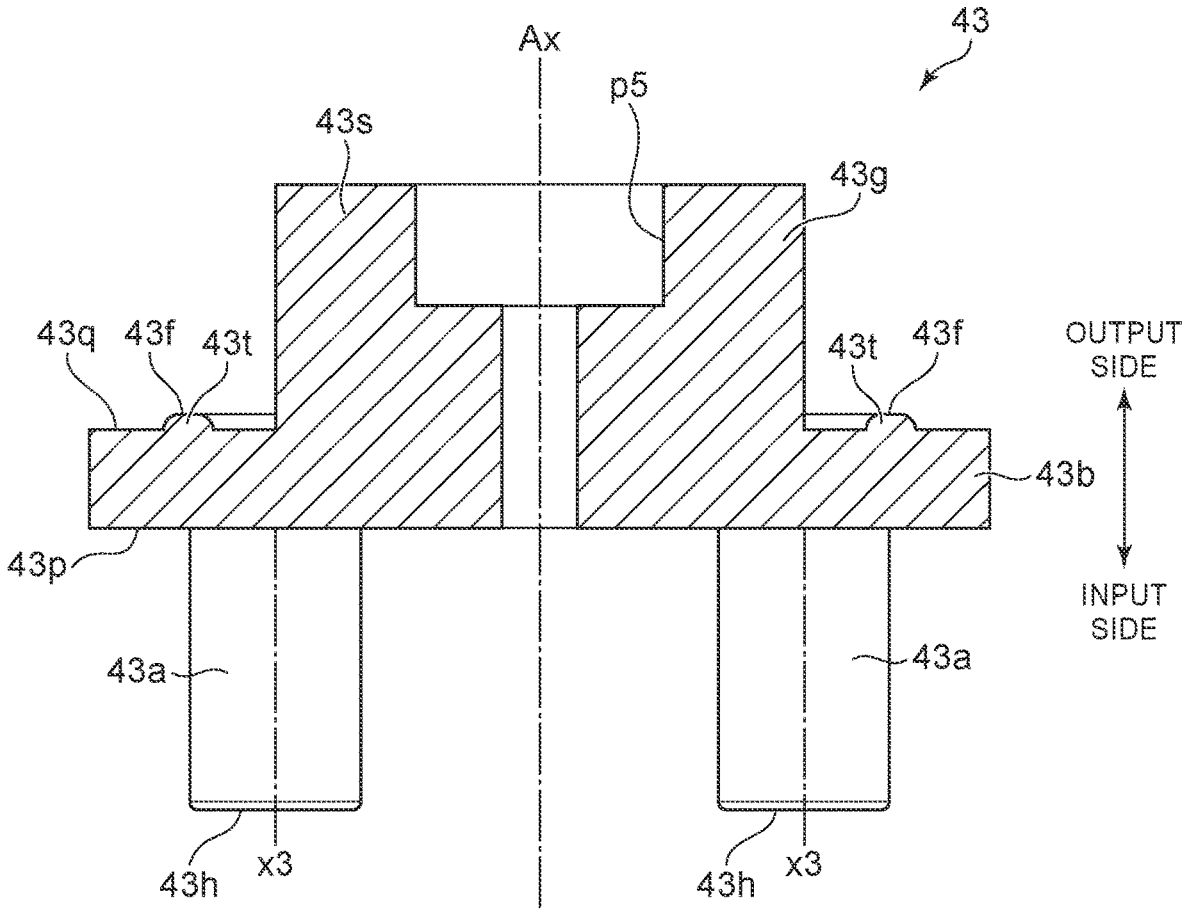
FIG. 13 is a cross-sectional view illustrating the planetary carrier of the electric opening/closing unit according to the embodiment.

FIG. 13 is a cross-sectional view illustrating the planetary carrier of the electric opening/closing unit according to the embodiment. FIG. 12A is a perspective view of the planetary carrier 43; FIG. 12B is a plan view of the planetary carrier 43 when viewed from the output side; and FIG. 12C is a plan view of the planetary carrier 43 when viewed from the input side. FIG. 13 is a cross section of line E-E shown in FIG. 12B.

The planetary carrier 43 includes a base 43*b*. The base 43*b* is, for example, discal. The base 43*b* includes an input-side surface 43*p*, and an output-side surface 43*q* at the side opposite to the input-side surface 43*p*. The input-side surface 43*p* and the output-side surface 43*q* extend along a plane perpendicular to the rotation axis Ax and are circular when viewed in plan. However, the base 43*b* may not always be circular when viewed in plan.

The shaft part 43*a* extends toward the input side from the input-side surface 43*p* of the base 43*b*. The shaft part 43*a* is cylindrical. The shapes of the multiple shaft parts 43*a* are the same. As illustrated in FIG. 12C, the multiple shaft parts 43*a* are arranged isotropically (i.e., about every 120°) when viewed from the rotation axis Ax. For example, as illustrated in FIG. 13, the center axis of the shaft part 43*a* corresponds to the rotational axis x3 of the planetary gear 23.

The gear part 43*s* extends toward the output side from the output-side surface 43*q* of the base 43*b*. Multiple teeth 43*g* that protrude in directions perpendicular to the rotation axis Ax are provided in the gear part 43*s*. For example, as illustrated in FIG. 13, a through-hole p5 is provided in the planetary carrier 43. The through-hole p5 extends in a direction parallel to the rotation axis Ax and extends through the centers of the base 43*b* and the gear part 43*s*.

The planetary carrier 43 also includes a protrusion 43*t* that protrudes toward the output side from the output-side surface 43*q*. The protrusion 43*t* is a circular rib that extends to surround the gear part 43*s*. For example, the center position of the circular protrusion 43*t* matches the position of the rotation axis Ax.

Figure 14A:
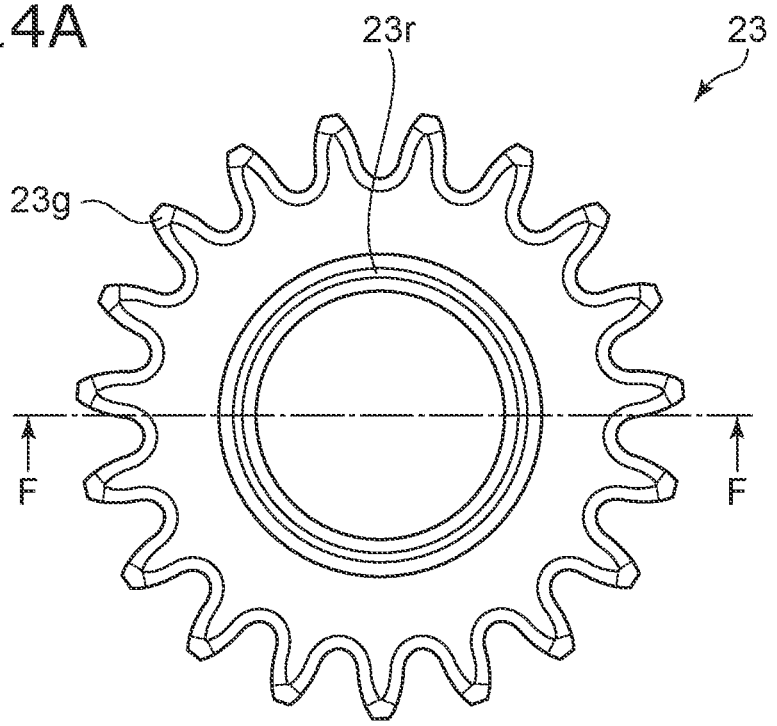
FIGS. 14A and 14B are a plan view and a cross-sectional view illustrating the planetary gear of the electric opening/closing unit according to the embodiment.
Figure 14B:
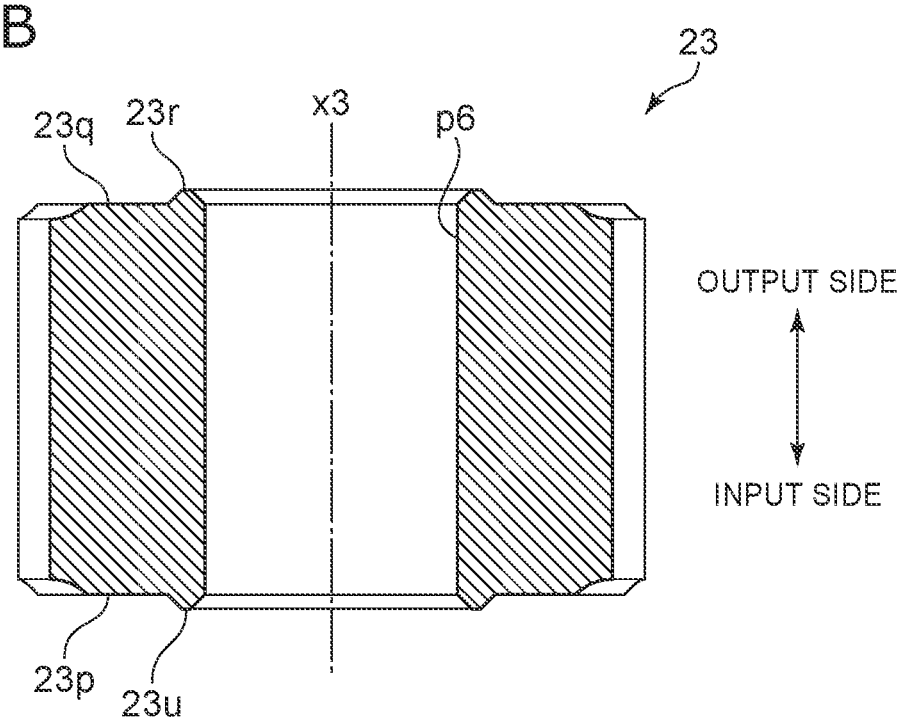

FIGS. 14A and 14B are a plan view and a cross-sectional view illustrating the planetary gear of the electric opening/closing unit according to the embodiment.

FIG. 14A is a plan view of the planetary gear 22 when viewed from the output side; and FIG. 14B is a cross section of line F-F shown in FIG. 14A.

The planetary gear 23 is substantially circular discal when viewed in plan; and multiple teeth 23*g* that protrude in directions perpendicular to the rotational axis x3 are provided in the outer circumference of the planetary gear 23. A through-hole p6 is provided in the planetary gear 23. The through-hole p6 extends in a direction parallel to the rotational axis x3 and extends through the center of the planetary gear 23. The shaft part 43*a* is inserted into the through-hole p6.

A circular protrusion 23*r* is located at an output-side surface 23*q* of the planetary gear 23. The protrusion 23*r* surrounds the periphery of the through-hole p6. The contact area between the planetary gear 23 and the planetary carrier 43 can be reduced by providing the protrusion 23*r*. Similarly, a circular protrusion 23*u* is located at an input-side surface 23*p* of the planetary gear 23. The protrusion 23*u* surrounds the periphery of the through-hole p6. The contact area between the planetary gear 23 and the planetary carrier 42 can be reduced by providing the protrusion 23*u*.

In the example as described above, the shaft part 43*a* and/or the gear part 43*s* are a part of the planetary carrier 43. For example, the shaft part 43*a* and the gear part 43*s* are molded as a continuous body with the base 43*b* of the planetary carrier 43. However, the configuration is not limited thereto; the shaft part 43*a* and/or the gear part 43*s* may be separate from the base 43*b* and may be combined as appropriate. It is sufficient for the shaft part 43*a* to be connected to the planetary gear 23 and for the planetary gear 23 to be rotatable with the shaft part 43*a* as the rotational axis. It is therefore sufficient for the rotational force of the planetary gear 23 to be transmitted to the gear part 43*s*. For example, the shaft part 43*a* may be fixed as a continuous body with the planetary gear 23 and may be rotatably connected with respect to the base 43*b*.

According to the embodiment, the shaft part of the second transmission part contacts the protrusion of the first planetary carrier and is separated from the first planetary carrier at a part other than the protrusion. A gap is formed between the shaft part of the second transmission part and the part of the first planetary carrier other than the protrusion. Specifically, as illustrated in FIG. 4, the end part of the shaft part 42*a* at the input side contacts the end part of the protrusion 41*t* at the output side. The shaft part 42*a* slides over the circular protrusion 41*t* when revolving around the rotation axis Ax. At this time, the shaft part 42*a* is separated from the planetary carrier 41 other than the protrusion 41*t*. In other words, the shaft part 42*a* is separated from the output-side surface 41*q* of the planetary carrier 41. A gap G1 is located between the output-side surface 41*q* and the end part of the shaft part 42*a* at the input side. The contact area between the shaft part 42*a* and the planetary carrier 41 can be reduced thereby, and the sliding resistance between the shaft part 42*a* and the planetary carrier 41 can be reduced.

For example, as illustrated in FIG. 4, the end part of the shaft part 43*a* at the input side contacts the end part of the protrusion 42*t* at the output side. The shaft part 43*a* slides over the circular protrusion 42*t* when revolving around the rotation axis Ax. At this time, the shaft part 43*a* is separated from the planetary carrier 42 other than the protrusion 42*t*. In other words, the shaft part 43*a* is separated from the output-side surface 42*q* of the planetary carrier 42. A gap G2 is located between the output-side surface 42*q* and the end part of the shaft part 43*a* at the input side. The contact area between the shaft part 43*a* and the planetary carrier 42 can be reduced thereby, and the sliding resistance between the shaft part 43*a* and the planetary carrier 42 can be reduced.

According to the embodiment as described above, the contact area between the first planetary carrier and the shaft part of the second planetary carrier can be reduced by providing the protrusion in the first planetary carrier. The sliding resistance between the first planetary carrier and the second planetary carrier can be reduced thereby. As a result, the rotational force can be efficiently transmitted.

As illustrated in FIG. 4, the protrusion 43*t* of the planetary carrier 43 contacts the inner surface of the internal gear 24 (the surface facing the output-side surface 43*q* of the planetary carrier 43). The output-side surface 43*q* of the planetary carrier 43 is separated from the internal gear 24. A gap G3 is located between the output-side surface 43*q* and the inner surface of the internal gear 24. The contact area between the internal gear 24 and the planetary carrier 43 can be reduced thereby, and the sliding resistance between the internal gear 24 and the planetary carrier 43 can be reduced.

For example, there are cases where a small uneven portion (not illustrated) is formed in the output-side surface 41*q* of the planetary carrier 41. The uneven portion is, for example, burr and/or sink marks due to the molding of the planetary carrier 41. More specifically, for example, gate marks, knock-out pin marks, etc., are caused by injection molding. When the shaft part 42*a* and such uneven portions contact, resistance is generated, and the torque is undesirably reduced. Therefore, a method may be considered in which the resistance is suppressed by preventing direct contact between the output-side surface 41*q* and the shaft part 42*a* by adding a smooth circular plate between the output-side surface 41*q* and the shaft part 42*a*. However, in such a case, there is a risk that the number of components may increase and the manufacturing cost may increase. In contrast, according to the embodiment, the shaft part 42*a* is separated from the output-side surface 41*q* by providing the protrusion 41*t*. Therefore, the increase of the resistance due to the uneven portion of the output-side surface 41*q* can be suppressed while suppressing the increase of the number of components. For example, it is desirable for a height dimension H1 (the length along the direction of the rotation axis Ax) of the protrusion 41*t* illustrated in FIG. 7 to be greater than the height of the uneven portion (the burr, etc.) of the output-side surface 41*q*, e.g., not less than 0.1 mm and not more than 1.0 mm, i.e., about 0.5 mm. This is similar for the protrusions 42*t* and 43*t* as well.

For example, as illustrated in FIG. 4, a width W41*t* (the length between the inner circumference and the outer circumference along the radial direction) of the protrusion 41*t* is less than a width W42*a* (the diameter) of the shaft part 42*a*. The contact area between the shaft part 42*a* and the planetary carrier 41 can be further reduced by reducing the width W41*t* of the protrusion 41*t*.

Similarly, as illustrated in FIG. 4, a width W42*t* of the protrusion 42*t* is less than a width W43*a* of the shaft part 43*a*; and the contact area between the shaft part 43*a* and the planetary carrier 42 can be further reduced by reducing the width W42*t* of the protrusion 42*t*.

In the example of FIG. 4, the distal end (the end at the input side) of the shaft part 42*a* protrudes further toward the input side than the planetary gear 22. For example, the distal end of the shaft part 42*a* is positioned further toward the input side than the input-side surface 21*p* or the protrusion 21*u* of the planetary gear 22 (see FIG. 8B).

Similarly, in the example of FIG. 4, the distal end (the end at the input side) of the shaft part 43*a* protrudes further toward the input side than the planetary gear 23. For example, the distal end of the shaft part 43*a* is positioned further toward the input side than the input-side surface 22*p* or the protrusion 22*u* of the planetary gear 23 (see FIG. 11B).

For example, as illustrated in FIG. 7, the protrusion 41*t* includes a surface 41*f* at the end part at the output side. In the example, the surface 41*f* is a plane perpendicular to the rotation axis Ax. The protrusion 41*t* contacts the shaft part 42*a* of the planetary carrier 42 at the surface 41*f*.

For example, as illustrated in FIG. 7, the shaft part 41*a* includes a surface 41*h* at the end part at the input side. In the example, the surface 41*h* is a plane perpendicular to the rotation axis Ax. The shaft part 41*a* contacts the case member 25 at the surface 41*h*.

For example, as illustrated in FIG. 10, the protrusion 42*t* includes a surface 42*f* at the end part at the output side. In the example, the surface 42*f* is a plane perpendicular to the rotation axis Ax. The protrusion 42*t* contacts the shaft part 43*a* of the planetary carrier 43 at the surface 42*f*.

For example, as illustrated in FIG. 10, the shaft part 42*a* includes a surface 42*h* at the end part at the input side. In the example, the surface 42*h* is a plane perpendicular to the rotation axis Ax. The shaft part 42*a* contacts the protrusion 41*t* of the planetary carrier 41 at the surface 42*h*.

For example, as illustrated in FIG. 13, the protrusion 43*t* includes a surface 43*f* at the end part at the output side. In the example, the surface 43*f* is a plane perpendicular to the rotation axis Ax. The protrusion 43*t* contacts the internal gear 24 at the surface 43*f*.

For example, as illustrated in FIG. 13, the shaft part 43*a* includes a surface 43*h* at the end part at the input side. In the example, the surface 43*h* is a plane perpendicular to the rotation axis Ax. The shaft part 43*a* contacts the protrusion 42*t* of the first planetary carrier 42 at the surface 43*h*.

Figure 15:
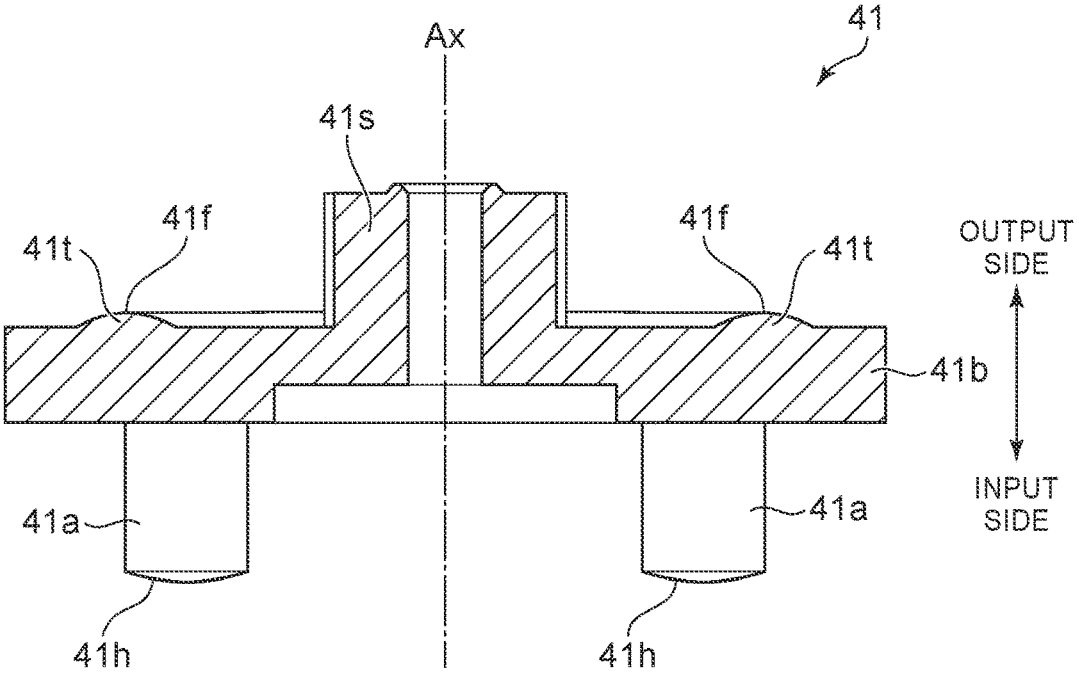
FIG. 15 is a cross-sectional view showing a modification of the planetary carrier of the electric opening/closing unit according to the embodiment.

FIG. 15 is a cross-sectional view showing a modification of the planetary carrier of the electric opening/closing unit according to the embodiment.

In the example, the surface 41*f* of the protrusion 41*t* of the planetary carrier 41 is a convex curved surface that protrudes toward the output side. The contact area between the protrusion 41*t* and the shaft part 42*a* can be reduced thereby, and the sliding resistance can be further reduced. Thus, the end of the protrusion 41*t* at the output side may be a curved surface, may be a plane as described above, or may be a corner.

In the example, the surface 41*h* of the shaft part 41*a* of the planetary carrier 41 is a convex curved surface that protrudes toward the input side. The contact area between the shaft part 41*a* and the case member 25 can be reduced thereby, and the sliding resistance can be further reduced. Thus, the end of the shaft part 41*a* at the input side may be a curved surface, may be a plane as described above, or may be a corner.

Figure 16:
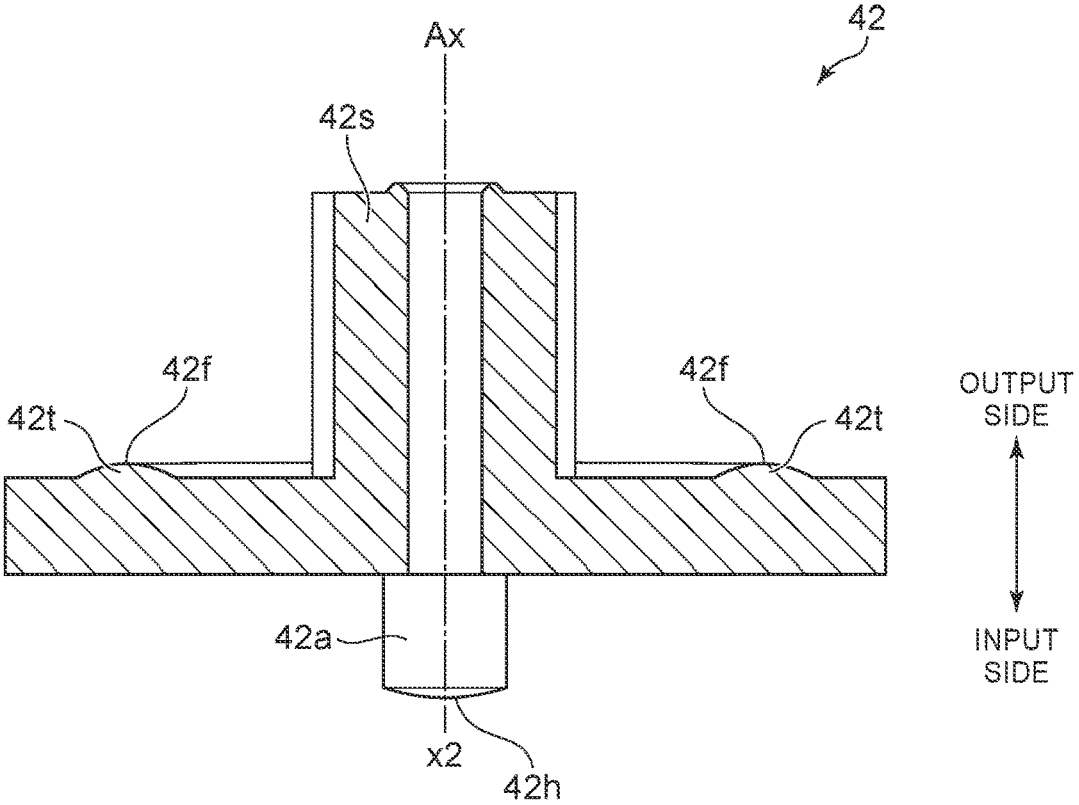
FIG. 16 is a cross-sectional view showing a modification of the planetary carrier of the electric opening/closing unit according to the embodiment.

FIG. 16 is a cross-sectional view showing a modification of the planetary carrier of the electric opening/closing unit according to the embodiment.

In the example, the surface 42*f* of the protrusion 42*t* of the planetary carrier 42 is a convex curved surface that protrudes toward the output side. The contact area between the protrusion 42*t* and the shaft part 43*a* can be reduced thereby, and the sliding resistance can be further reduced. Thus, the end of the protrusion 42*t* at the output side may be a curved surface, may be a plane as described above, or may be a corner.

In the example, the surface 42*h* of the shaft part 42*a* of the planetary carrier 42 is a convex curved surface that protrudes toward the input side. The contact area between the shaft part 42*a* and the protrusion 41*t* can be reduced thereby, and the sliding resistance can be further reduced. Thus, the end of the shaft part 42*a* at the input side may be a curved surface, may be a plane as described above, or may be a corner.

Figure 17:
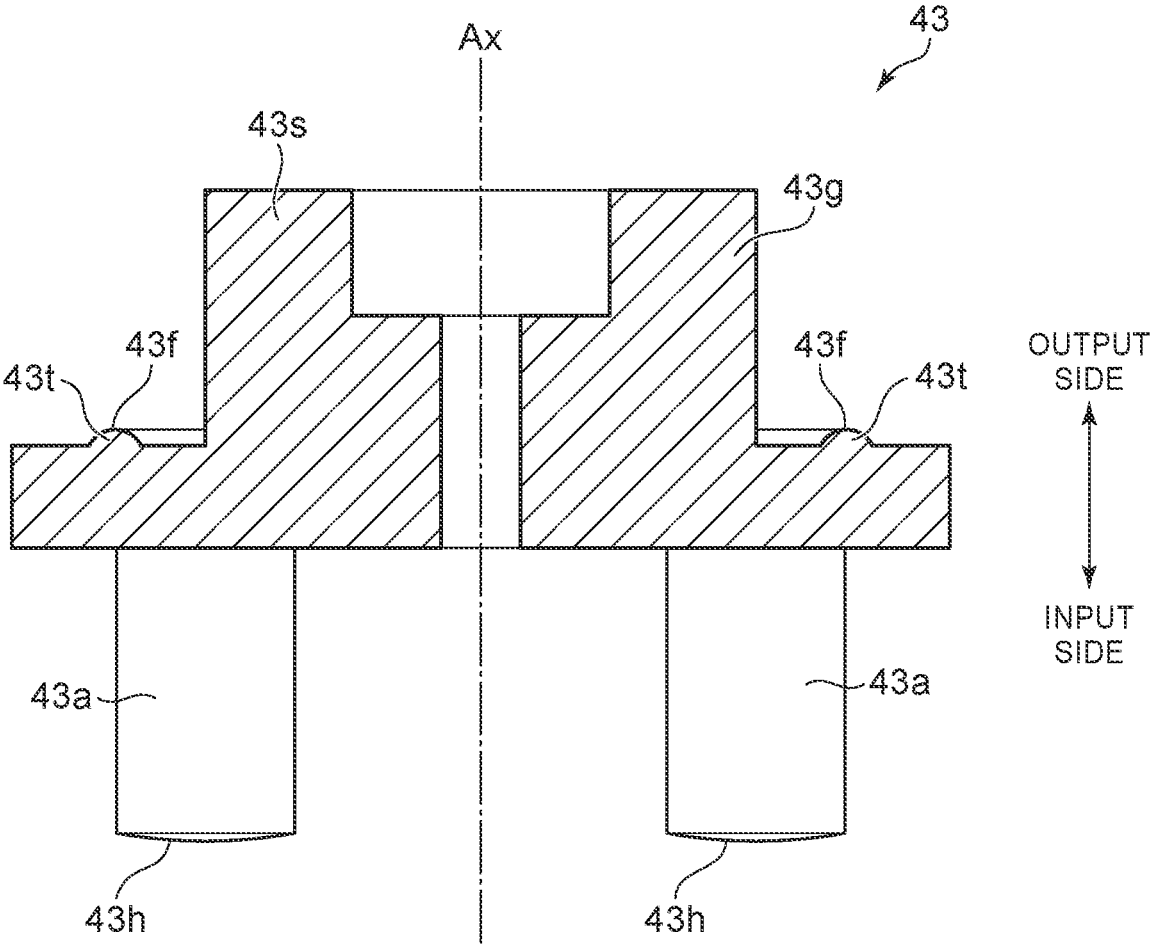
FIG. 17 is a cross-sectional view showing a modification of the planetary carrier of the electric opening/closing unit according to the embodiment.

FIG. 17 is a cross-sectional view showing a modification of the planetary carrier of the electric opening/closing unit according to the embodiment.

In the example, the surface 43*f* of the protrusion 43*t* of the planetary carrier 43 is a convex curved surface that protrudes toward the output side. The contact area between the protrusion 43*t* and the internal gear 24 can be reduced thereby, and the sliding resistance can be further reduced. Thus, the end of the protrusion 43*t* at the output side may be a curved surface, may be a plane as described above, or may be a corner.

In the example, the surface 43*h* of the shaft part 43*a* of the planetary carrier 43 is a convex curved surface that protrudes toward the input side. The contact area between the shaft part 43*a* and the protrusion 42*t* can be reduced thereby, and the sliding resistance can be further reduced. Thus, the end of the shaft part 43*a* at the input side may be a curved surface, may be a plane as described above, or may be a corner.

The invention has been described with reference to the embodiments. However, the invention is not limited to these embodiments. Any design changes in the above embodiments suitably made by those skilled in the art are also encompassed within the scope of the invention as long as they fall within the spirit of the invention. For example, the shape, the size the material, the disposition and the arrangement or the like of the components included in the toilet device are not limited to illustrations and can be changed appropriately.

The components included in the embodiments described above can be combined to the extent possible, and these combinations are also encompassed within the scope of the invention as long as they include the features of the invention.

What is claimed is:

1. A toilet device, comprising:

an electric opening/closing unit configured to open and close at least one of a toilet seat or a toilet lid, the electric opening/closing unit including a motor, and a transmission mechanism transmitting a rotation of the motor to one of the toilet seat or the toilet lid, the transmission mechanism including an internal gear including teeth provided in an inner circumferential surface of the internal gear, the internal gear being tubular, a first transmission part housed in the internal gear, the first transmission part transmitting a rotational force of the motor, and a second transmission part housed in the internal gear, the second transmission part transmitting a rotational force of the first transmission part, the first transmission part including a first planetary gear to which the rotational force of the motor is transmitted, the first planetary gear revolving around a rotation axis along the inner circumferential surface of the internal gear while rotating, and a first planetary carrier rotating around the rotation axis as the first planetary gear rotates and revolves, the second transmission part including a second planetary gear to which a rotational force of the first planetary carrier is transmitted, the second planetary gear revolving around the rotation axis along the inner circumferential surface of the internal gear while rotating, a second planetary carrier rotating around the rotation axis as the second planetary gear rotates and revolves, and a shaft part including a rotational axis of the second planetary gear, the shaft part revolving around the rotation axis, the first planetary carrier including a protrusion extending along a trajectory of the revolution of the shaft part, the shaft part contacting the protrusion, a gap being formed between the shaft part and a part of the first planetary carrier other than the protrusion.

2. The device according to claim 1, wherein the protrusion includes a convex curved surface contacting the shaft part.

3. The device according to claim 1, wherein the shaft part includes a convex curved surface contacting the protrusion.

* * * * *